US007154088B1

(12) United States Patent
Blain et al.

(10) Patent No.: US 7,154,088 B1
(45) Date of Patent: Dec. 26, 2006

(54) MICROFABRICATED ION TRAP ARRAY

(75) Inventors: Matthew G. Blain, Albuquerque, NM (US); James G. Fleming, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 85 days.

(21) Appl. No.: 11/089,318

(22) Filed: Mar. 23, 2005

Related U.S. Application Data

(60) Provisional application No. 60/610,395, filed on Sep. 16, 2004.

(51) Int. Cl.
*H01J 49/42* (2006.01)

(52) U.S. Cl. ..... 250/292

(58) Field of Classification Search ..... None
See application file for complete search history.

(56) References Cited

U.S. PATENT DOCUMENTS

| | | | | |
|---|---|---|---|---|
| 5,248,883 | A * | 9/1993 | Brewer et al. | 250/292 |
| 6,762,406 | B1 * | 7/2004 | Cooks et al. | 250/292 |
| 6,870,158 | B1 | 3/2005 | Blain | |
| 6,967,326 | B1 * | 11/2005 | Pai et al. | 250/292 |
| 7,081,623 | B1 * | 7/2006 | Pai et al. | 250/292 |
| 2006/0169882 | A1 * | 8/2006 | Pau et al. | 250/281 |

OTHER PUBLICATIONS

E. R. Badman, Miniature mass analyzers, Journal of Mass Spectrometry, 35, (2000) 659-671.

H. G. Dehmelt, Radiofrequency Spectroscopy of Stored Ions I: Storage, Adv. Atom. Mol. Phys., (1967) 3, 53-72.

E. R. Badman, Cylindrical Ion Trap Array with Mass Selection by Variation in Trap Dimensions, Anal. Chem., vol. 72, No. 20, Oct. 15, 2000, 5079-5086.

E. R. Badman, A Parallel Miniature Cylindrical Ion Trap Array, Anal. Chem., vol. 72, No. 14, Jul. 15, 2000, 3291-3297.

Z. Ouyang, Characterization of a Serial Array of Miniature Cylindrical Ion Trap Mass Analyzers, Rapid Communications in Mass Spectrometry, 13, (1999) 2444-2449.

Curtis D. Mowry, Proceedings published in Micro Total Analysis Systems 2002, held in Nara, Japan, Nov. 3-7, 2002, Kluwer Academic Publishers, pp. 521-523, 2002.

M. G. Blain, Towards the hand-held mass spectrometer: design considerations, simulation, and fabrication of micrometer-scaled cylindrical ion traps, International Journal of Mass Spectrometry, 236 (2004) 91-104.

J. C. Schwartz, A Two-Dimensional Quadrupole Ion Trap Mass Spectrometer, American Society for Mass Spectrometry, 2002, 13, 659-669.

Shenheng Guan, Stored waveform inverse Fourier transform (SWIFT) ion excitation in trapped-ion mass spectrometry: theory and applications, International Journal of Mass Spectrometry and Ion Processes 157/158 (1996) 5-37.

* cited by examiner

*Primary Examiner*—Jack I. Berman
(74) *Attorney, Agent, or Firm*—Kevin W. Bieg

(57) ABSTRACT

A microfabricated ion trap array, comprising a plurality of ion traps having an inner radius of order one micron, can be fabricated using surface micromachining techniques and materials known to the integrated circuits manufacturing and microelectromechanical systems industries. Micromachining methods enable batch fabrication, reduced manufacturing costs, dimensional and positional precision, and monolithic integration of massive arrays of ion traps with microscale ion generation and detection devices. Massive arraying enables the microscale ion traps to retain the resolution, sensitivity, and mass range advantages necessary for high chemical selectivity. The reduced electrode voltage enables integration of the microfabricated ion trap array with on-chip circuit-based rf operation and detection electronics (i.e., cell phone electronics). Therefore, the full performance advantages of the microfabricated ion trap array can be realized in truly field portable, handheld microanalysis systems.

28 Claims, 17 Drawing Sheets

MICROFABRICATED ION TRAP ARRAY

CROSS-REFERENCE TO RELATED APPLICATION

This application claims the benefit of U.S. Provisional Application No. 60/610,395, filed Sep. 16, 2004, which is incorporated herein by reference.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to ion storage and analysis and, in particular, to a microscale ion trap array fabricated using surface micromachining techniques.

BACKGROUND OF THE INVENTION

A mass spectrometer (MS) is a device that filters gaseous ions according to their mass-to-charge (m/z) ratio and measures the relative abundance of each ionic species. Mass spectrometry is particularly attractive for in-situ analysis, due to its inherent speed, excellent sensitivity, molecular selectivity, and capability for continuous real-time measurements. A typical mass spectrometer comprises an ion source, wherein the ions are generated; a mass filter, wherein the ions are separated in space or in time; an ion detector, wherein the filtered ions are collected and their relative ion abundance measured; a vacuum system; and means to power the spectrometer. Depending on the type of sample and the method of introducing the sample into the mass spectrometer, ions can be generated in the ion source by electron impact ionization, photoionization, thermal ionization, chemical ionization, desorption ionization, spray ionization, or other processes. Mass spectrometers are generally classified according to the method on which mass filtering is accomplished using electric and/or magnetic fields. Mass filter types include magnetic-sector, time-of-flight, linear quadrupole, ion cyclotron resonance, and ion traps. Detection of ions is typically accomplished by a single-point ion collector, such as a Faraday cup or electronic multiplier, or a multipoint collector, such as an array or microchannel plate collector, whereby all of the ions arrive at the collector simultaneously.

Mass spectrometer performance is generally given in terms of mass range, resolution (i.e., resolving power), and sensitivity of the instrument. Mass range is the lowest and highest masses that can be measured. A large mass range is desired for the analysis of high molecular weight organic and biological analytes. Resolution measures the ability of the instrument to separate and identify ions of slightly different masses. Typically, the resolution for singly charged ions is given by $$R = \frac{m}{\Delta m} \tag{1}$$

where m is the mass of an ion peak in atomic mass units and Δm is the width of the peak at some peak height level (e.g., half peak height). In many cases, the minimum resolution required is such that a molecular ion can be resolved from an adjacent peak having a unit mass difference. According to this requirement, the resolution R should be at least 100 for a chemical species having a nominal mass of 100. High-resolution instruments, required for organic mass spectrometry, can detect peaks separated by fractions of a mass unit. Sensitivity is a measure of the instrument's response to ions of an arbitrary m/z ratio for a particular sample. Sensitivity is typically a function of the efficiency of the ion source and ion detector, as well as the analyzer method used. The sensitivity limit, or detection limit, is the minimum amount of a sample that can be detected under a given set of experimental conditions and distinguished from the instrument noise level and background. Resolution and sensitivity are approximately inversely related to each other. Other important characteristics of a spectrometer instrument include overall size, operating pressure, voltage, and power consumption.

Mass spectrometers can be used for chemical sensing. Analyzing mixtures may be difficult when the mass spectrometer is used alone, since the resulting mass spectrum would be a complex summation of the spectra of the individual components. Therefore, analytical techniques combining the separation methods of gas chromatography and mass spectrometry are often used for chemical sensing. A gas chromatograph (GC) separates volatile mixtures into their component chemical species, which are eluted from a long capillary. The eluents can then be transferred into a mass spectrometer to obtain a mass spectrum of each of the separated components, from which the molecular structure of the individual component species can be inferred. The GC/MS is therefore capable of separating highly complex mixtures, identifying the components, and quantifying their amounts. Alternatively, tandem (MS/MS) or multistage ($MS^n$) mass spectrometers can be combined, wherein one of the mass spectrometers is used to isolate individual ions according to their m/z ratio, and the other is used to examine the fragmentation products of the individual ions. Thus, multiple stages of mass analysis can be obtained in a single analyzer.

Recently, there has been a growing interest in miniature mass spectrometers that enable reduced size, power requirements, vacuum system demands, cost, and complexity. The effect of miniaturization on performance depends on the method of mass analysis. For most methods, mass range and resolution decrease with miniaturization. However, sensitivity may be improved, while power and pumping requirements may be reduced compared to conventional instruments. In particular, the smaller dimensions of miniature analyzers reduces the number of collisions that the ion makes with background gases due to the reduced distance of travel. Therefore, operating pressure requirements may be relaxed with miniaturization. See E. R. Badman and R. G. Cooks, "Miniature mass analyzers," *J. Mass Spectrometry* 35, 659 (2000).

Magnetic-sector instruments deflect ions, traveling at constant velocity in a perpendicular magnetic field, along a curved path thereby dispersing them in space according to their m/z values. Alternatively, the magnetic field of the sector can be scanned to sweep the ions across a point detector. Sector mass spectrometers can have high resolution and high mass accuracy, even for high-energy analysis. However, quite large magnetic fields, on the order of tens of Tesla, are required to maintain resolution and detectable mass range as the size of the sector is reduced. Therefore, magnetic-sector instruments are not well-suited to miniaturization.

In a time-of-flight (TOF) mass spectrometer, ions are accelerated to approximately constant kinetic energy in a pulse and allowed to drift down a long flight tube. The TOF mass spectrometer thereby enables temporal discrimination of ions according to their flight time, which is determined by their m/z ratio. Conventional TOF mass spectrometers typically have a high mass range, short analysis time, and are relatively low cost. However, for miniaturized TOF mass spectrometers, the accelerating voltage must be decreased to maintain mass range as the drift length is reduced, seriously degrading resolution.

Linear quadruple mass spectrometers (QMS) filter ions by passing them through tuned radiofrequency (rf) and direct current (dc) electrical fields defined by four, symmetrically parallel quadrupole rods. The QMS permits only those ions with a stable trajectory, determined by their m/z ratio, to travel along the entire length of the central axis of the rod assembly without being deflected out of the intra-rod space. Ions with different m/z ratios can be scanned through the QMS by continuously varying the field between the quadrupole rods. Therefore, the QMS is a variable bandpass filtering ion optic. Miniature linear quadrupoles require lower drive voltages and higher rf drive frequencies to filter heavier ions and maintain resolution as the electrode dimensions decrease. The relative dimensional and positional precision of the parts must be maintained as their size is reduced, although the rod length remains large, relative to the aperture, to provide adequate filtering. However, the QMS is relatively pressure intolerant and can operate effectively at relatively high pressures (e.g., $10^{-4}$ Torr). Therefore, they are more amenable to miniaturization due to the avoidance of bulky vacuum pumping systems.

A three-dimensional analogue of the linear QMS is the quadrupole ion trap (QIT), or Paul trap. Like the linear quadrupole, the QIT can control the stability of ion motion in an electric field and can therefore be used for mass analysis. The QIT comprises a central, donut-shaped hyberboloid ring electrode and two hyperbolic endcap electrodes. In normal usage, the endcaps are held at ground potential, and the rf oscillating drive voltage is applied to the ring electrode. Ion trapping occurs due to the formation of a trapping potential well in the central intraelectrode volume when appropriate time-dependent voltages are applied to the electrodes. The ions orbit in the trap and are stabilized or destabilized as the trapping conditions are changed. With mass-selective ejection of ions, the ions become unstable in the axial direction of the well and are ejected from the trap in order of ascending m/z ratio as the rf voltage applied to the ring is ramped. The ejected ions can be detected by an external detector, such as an electron multiplier, after passing through an aperture in one of the endcap electrodes. Like the QMS, ion traps have the advantage of being able to operate at higher pressures. Indeed, a background pressure of a light buffer gas (e.g., $10^{-3}$ Torr of helium) is often used to collisionally "cool" the kinetic energy of the trapped ions to achieve coherence, thereby improving the mass resolution and sensitivity of the analyzed ions.

Unlike most other methods of mass analysis, a decrease in the dimensions of the QIT allows trapping of higher m/z ratio ions for fixed operating parameters. Alternatively, for a given m/z ratio, the voltage required to eject ions is reduced quadratically with the linear trap dimension, enabling lower voltages to be used to analyze the same mass range. Like the linear quadrupole, the drive frequency of the QIT must be increased to maintain resolution as the spectrometer dimensions are decreased. The major problem with the miniature ion trap is that the ion storage capacity of the trap decreases with size, reducing the dynamic range and sensitivity.

A cylindrical ion trap (CIT), comprising planar endcap electrodes and a cylindrical ring electrode, rather than hyperbolic electrode surfaces, produces a field that is approximately quadrupolar near the center of the trap. Therefore, CITs have been found to provide performance comparable to QITs. Moreover, the CIT is favored for miniature ion storage and mass analysis devices, because CITs are relatively simple and can be easily machined. Arrays of miniature CITs, with trap dimensions on the order of a millimeter, have been manufactured using precision machining to regain a portion of the lost storage capacity and thereby improving sensitivity. See U.S. Pat. No. 6,762,406 to Cooks et al., which is incorporated herein by reference.

The inner radius $r_0$ of the trapping ring electrode determines the m/z ratio of the trapped ions. Therefore, variable $r_0$ parallel arrays of miniature CITs, each individual trap having a proportionately different size, can be configured to simultaneously trap and monitor different-sized ions. A low-resolution spectra of a multiple ion sample can be obtained from such a variable $r_0$ parallel array by simultaneously ejecting the trapped ions with a dc pulse, without the need to scan the applied rf voltage. The ejected ions can be detected with a position-sensitive detector, resulting in a reduced power requirement and simplification of the ion trap control electronics. See Badman et al., "Cylindrical Ion Trap Array with Mass Selection by Variation in Trap Dimensions," *Anal. Chem.* 72(20), 5079 (2000).

Alternatively, the use of multiple traps in a single $r_0$ parallel array can offset some of the loss in ion storage capacity with miniaturization. In the standard mass-ejection analysis mode, parallel arrays of miniature CITs having the same trap dimensions can be scanned to provide simultaneous ejection of similar ions from all traps, providing improved sensitivity. See Badman et al., "A Parallel Miniature Cylindrical Ion Trap Array," *Anal. Chem.* 72(14), 3291 (2000).

Serial arrays of such miniature CITs can be also be used for ion storage, mass selection, and ion reaction and product ion analysis. For example, serial arrays of miniature CITs, wherein ions trapped in a first CIT are transferred to a second CIT, can be used to provide multiple stages of mass isolation and analysis in a tandem MS/MS or multistage MS capability. See Z. Ouyang et al., "Characterization of a Serial Array of Miniature Cylindrical Ion Trap Mass Analyzers," *Rapid Comm. Mass Spect.* 13, 2444 (1999).

However, prior precision machining methods only provide arrays of miniature CITs comprising a few millimeter-sized traps. Furthermore, bulk micromachining techniques, whereby holes are etched in a semiconductor body or wafer, provide traps with trap dimensions comparable to the wafer thickness (i.e., tens to hundreds of microns). These relatively large traps are not well suited for truly field portable, handheld microanalytical systems. Such microanalytical systems, which have been termed "chemical laboratories on a chip," are being developed to enable the rapid and sensitive detection of particular chemicals, including pollutants, high explosives, and chemical warfare agents. These microanalytical systems should provide a high degree of chemical selectivity to discriminate against potential background interferents, be able to perform the chemical analysis on a short time scale, and consume low amounts of electrical power for prolonged field use. See C. D. Mowry et al., "Field testing and new applications of gas phase miniature chemical analysis systems," *Proc. 6th Int. Sym. Micro Total Analysis Systems*, Nara, Japan, Kluwer Academic Publishers, p. 521 (2002).

SUMMARY OF THE INVENTION

The present invention is directed to a microfabricated ion trap array, comprising an insulating substrate; a bottom endcap electrode layer, comprising a plurality of interconnected bottom endcap electrodes, on the substrate; a center ring electrode layer, comprising a plurality of interconnected ring electrodes axially aligned with the plurality of bottom endcap electrodes and separated therefrom by an air gap; a top endcap electrode layer, comprising a plurality of interconnected top endcap electrodes axially aligned with the plurality of ring electrodes and separated therefrom by an air gap; and means for applying a radiofrequency drive voltage between the center ring electrode layer and the endcap electrode layers to provide an ion trap in each of the intraelectrode volumes formed by the plurality of aligned bottom endcap electrodes, ring electrodes, and top endcap electrodes. Each top endcap electrode can further comprise an injection aperture for injecting an ionized or neutral sample gas into the intraelectrode volume. Each bottom endcap electrode can further comprise an extraction aperture for ejecting ions from the intraelectrode volume. The microfabricated ion trap array can further comprise an ion collector layer between the substrate and the bottom endcap electrode layer, the ion collector layer comprising a plurality of interconnected ion collectors axially aligned with the plurality of bottom endcap electrodes and separated therefrom by an air gap. The substrate can be silicon and the electrodes can be a metal, such as tungsten. The microfabricated ion trap array can have individual trap dimensions of order one micrometer (i.e., generally from about ten microns to sub-micron in radius). Massive arraying enables the microfabricated ion trap array to retain the mass range, resolution, and sensitivity advantages necessary for high chemical selectivity.

The microscale ion trap array can be fabricated using surface micromachining techniques and materials known to the integrated circuits (IC) manufacturing and microelectromechanical systems (MEMS) industries. Preferably, the ion trap array can be fabricated using a metal damascene process to build up successive layers of the ion trap structure. Metal damascene is an inlaid process in which a trench is formed in a surface layer and a metal overfill is deposited into the trench. A chemical-mechanical-polishing (CMP) step is used to re-planarize the surface and isolate the metal in the trench. With CMP, the thickness of the layer can be precisely adjusted to provide precise vertical dimensioning of the layers. Such methods enable batch fabrication, reduced manufacturing costs, dimensional and positional precision, and monolithic integration of massive arrays of ion traps with microscale ion generation and detection devices.

In addition to miniaturization of the mass analyzer itself, power reduction using microfabricated ion trap arrays may be envisioned by virtue of the ability to monolithically integrate the rf drive and signal detection electronics in the silicon substrate. Such integration may enable wireless transmission for remote site sensing and data reduction, and sharing across a network. By way of example, a conventional benchtop ion trap mass spectrometer (weighing, for example, 225 kg) can achieve a mass range of 2000 amu and uses a maximum rf voltage of 7500 V at about 1 MHz. Such a device consumes some 2400 W power, with about 40% being required for the rf electrical system and the balance for the vacuum system. A microscale (e.g., 1 μm radius) ion trap array requires high frequency rf (up to a few GHz) with dramatically reduced voltage requirements (10 s of volts). These power and frequency ranges are accessible with existing solid-state electronics and approach the class of cell phone electronics.

Furthermore, the microfabricated ion trap array can be integrated with a microfabricated gas chromatography column for the analysis of complex mixtures, or stacked in serial arrays to provide a tandem or multistage mass isolation and analysis capability. Therefore, the full performance advantages of microfabricated ion trap arrays can be realized in truly field portable, handheld microanalysis systems. Finally, in addition to mass analysis, the microfabricated ion trap array can be used to store ions (e.g., as in quantum computing applications, atomic/molecular physics experiments, etc.).

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

V for a microscale CIT. Ions were considered trapped if they remained in the CIT for 2000 cycles. A maximum trapping efficiency is achieved at an approximated $q_z$ value of 0.4.

Figure 10:
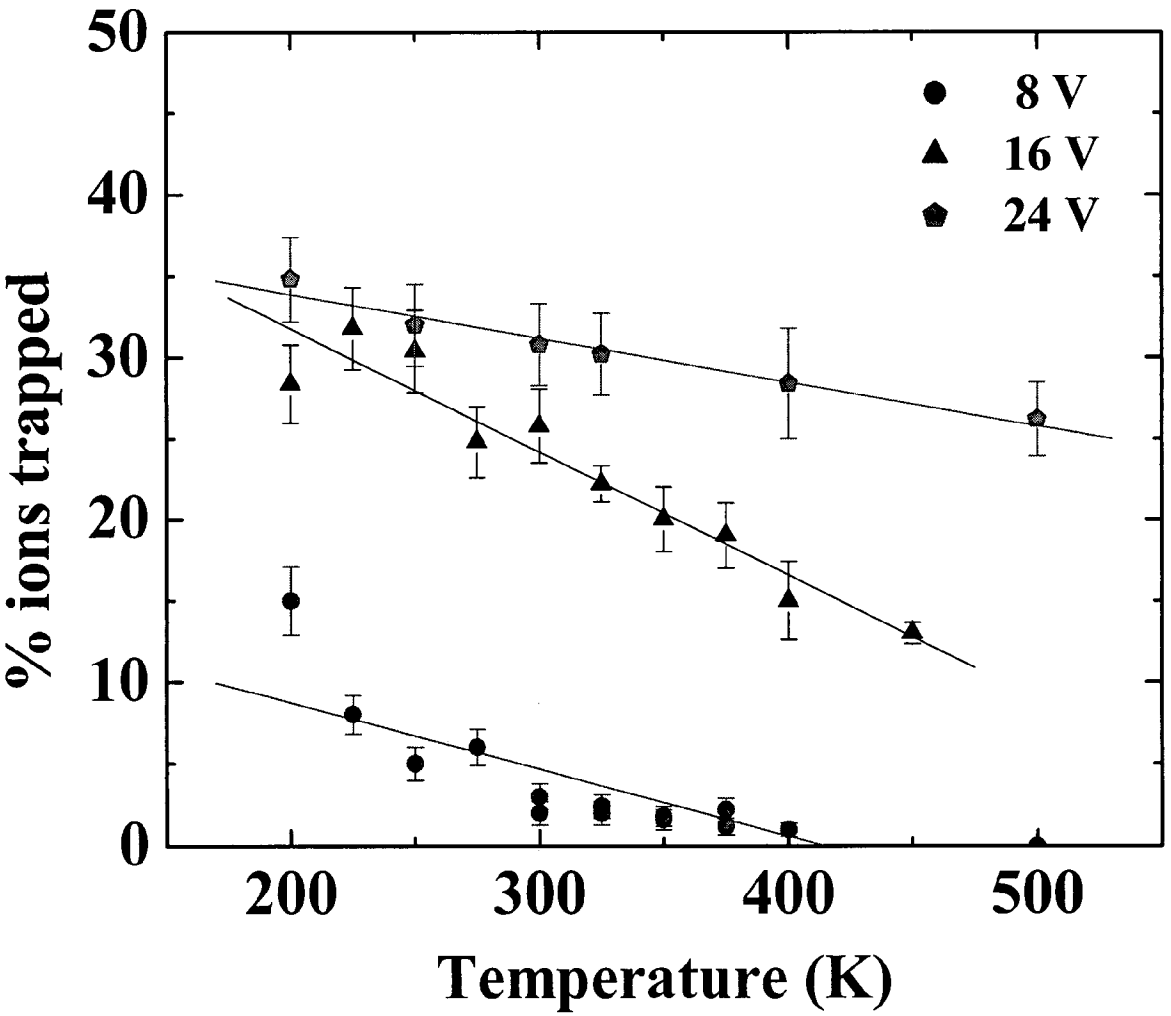

FIG. 10 shows plots of simulation results for percent ions (m/z=93, $q_z$ constant at 0.4) trapped as a function of temperature for ions trapped in a microscale CIT at 8, 16, and 24 V. Ions were considered trapped if they remained in the CIT for 2000 cycles. Error bars represent the standard deviation of the percentage of ions trapped. A linear decline is seen in trapping efficiency as temperature increases. Rates of change decrease as the voltage increases.

Figure 11:
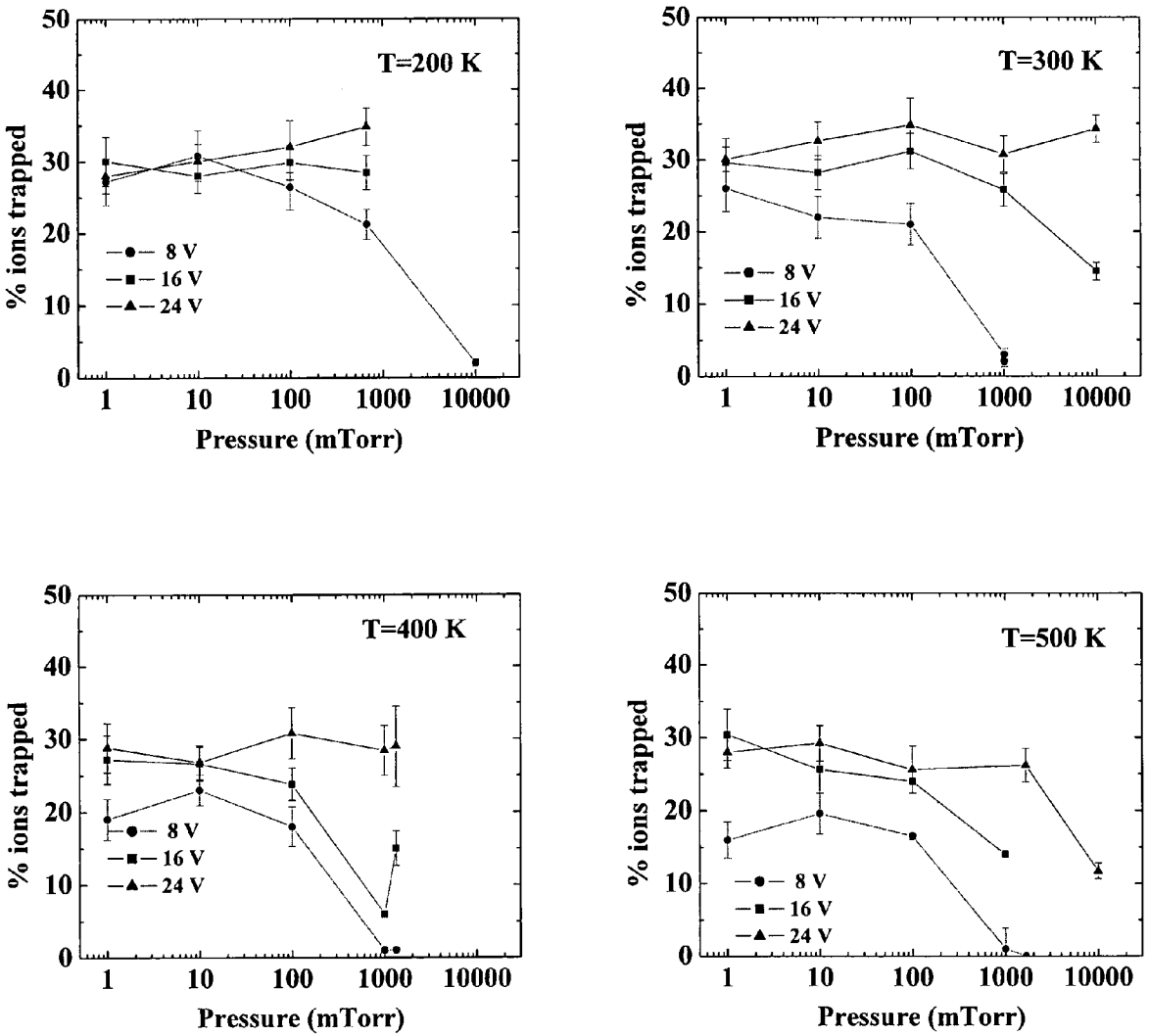

FIG. 11 shows plots of simulation results for percent ions (m/z=93) trapped in a microscale CIT as a function of He pressure at 8, 16, and 24 V for various temperatures: 200 K, 300 K, 400 K, and 500 K. Ions were considered trapped if they remained in the CIT for 2000 cycles. Error bars represent the standard deviation of the percentage of ions trapped. Trapping efficiency decreases as pressure increases, however higher voltages (24 V) retain trapping efficiency at pressures of a Torr and higher.

Figure 12:
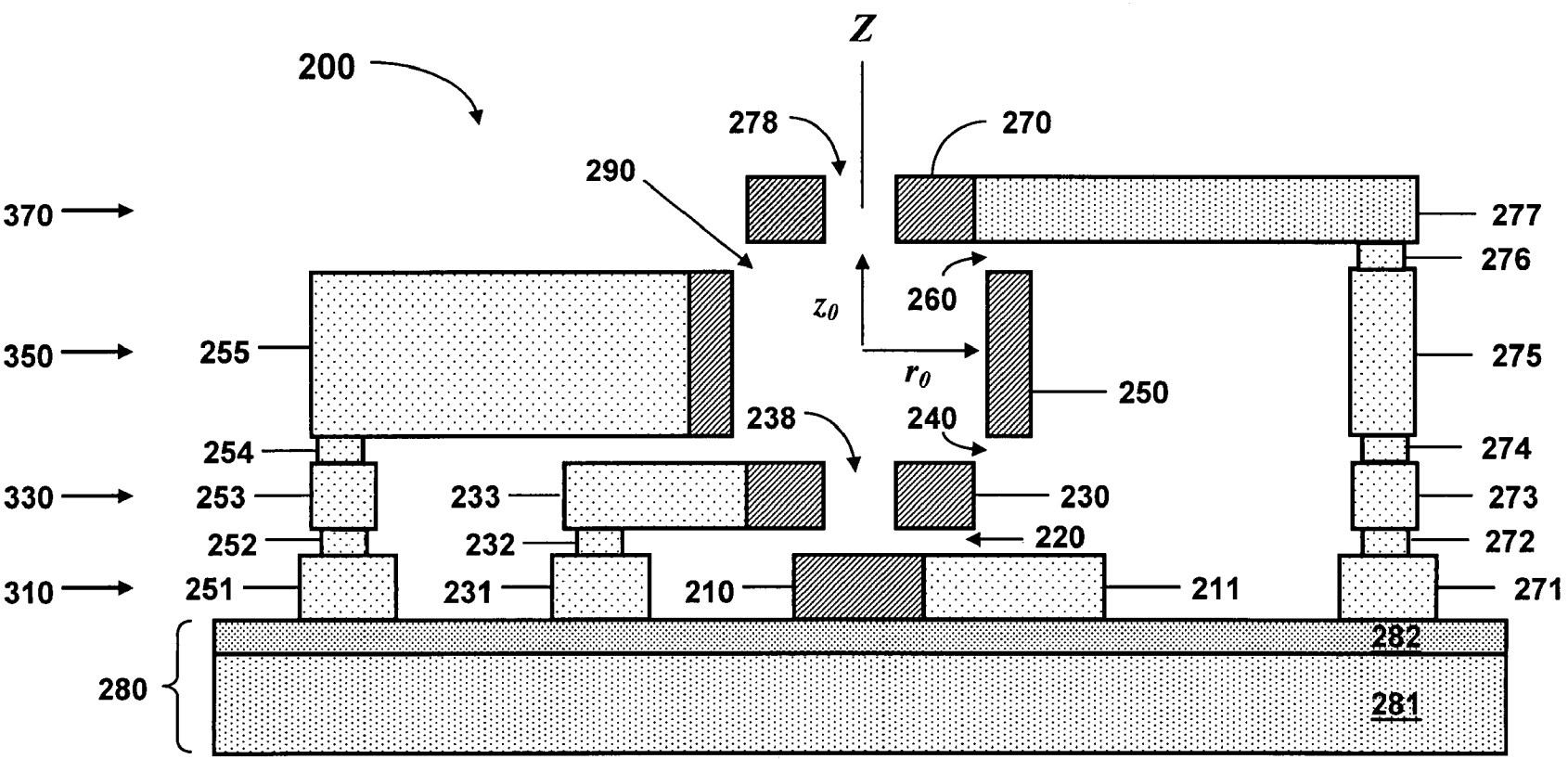

FIG. 12 shows a schematic cross-sectional side view of a single microfabricated ion trap, showing anchor and support structures, electrodes, and ion collector.

Figure 13B:
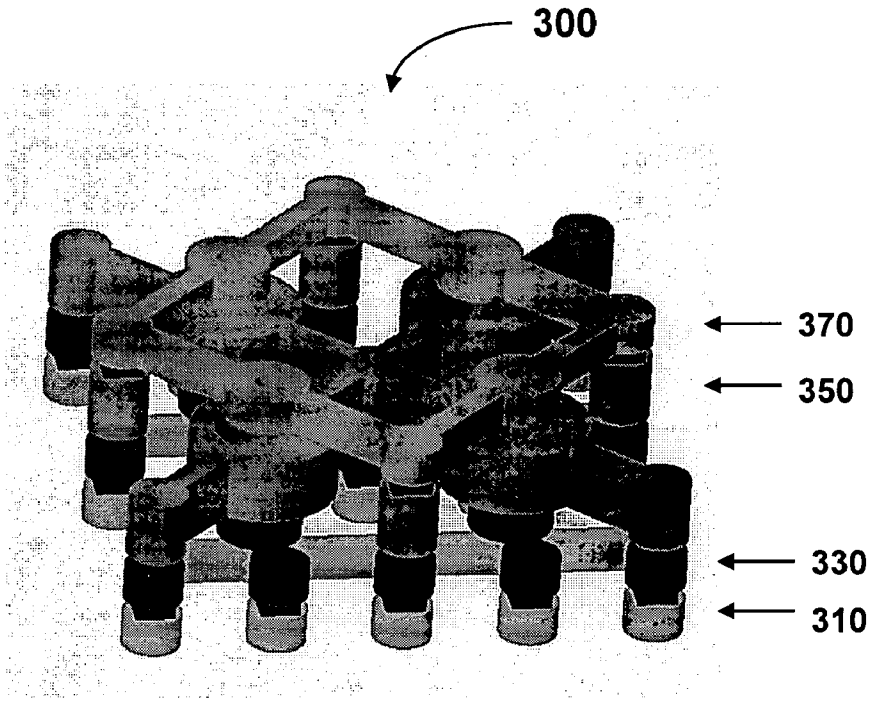
Figure 13A:
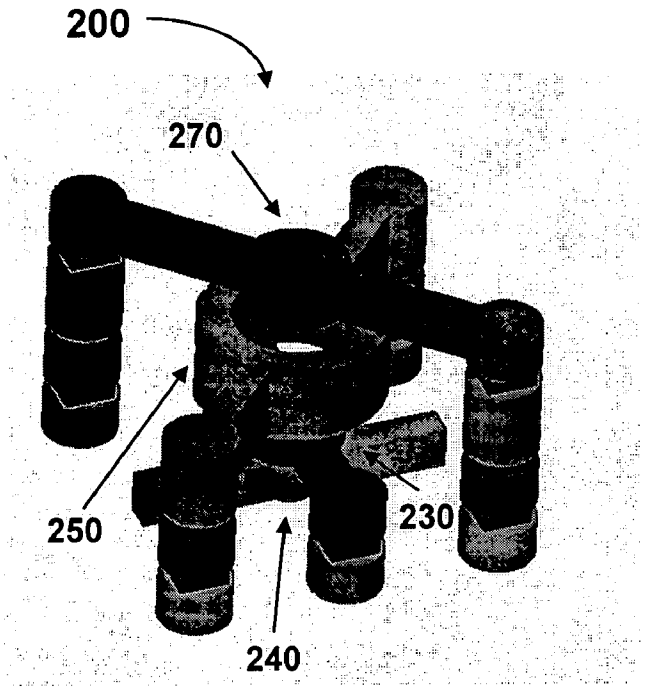

FIG. 13A shows a perspective view of a three-dimensional model of a single microfabricated ion trap. FIG. 13B shows a perspective view of a three-dimensional model of a microfabricated array of four ion traps.

FIGS. 14A–14I show schematic cross-sectional views of a seven-layer metal damascene process to fabricate a parallel array of microscale ion traps on a common substrate.

Figure 15:
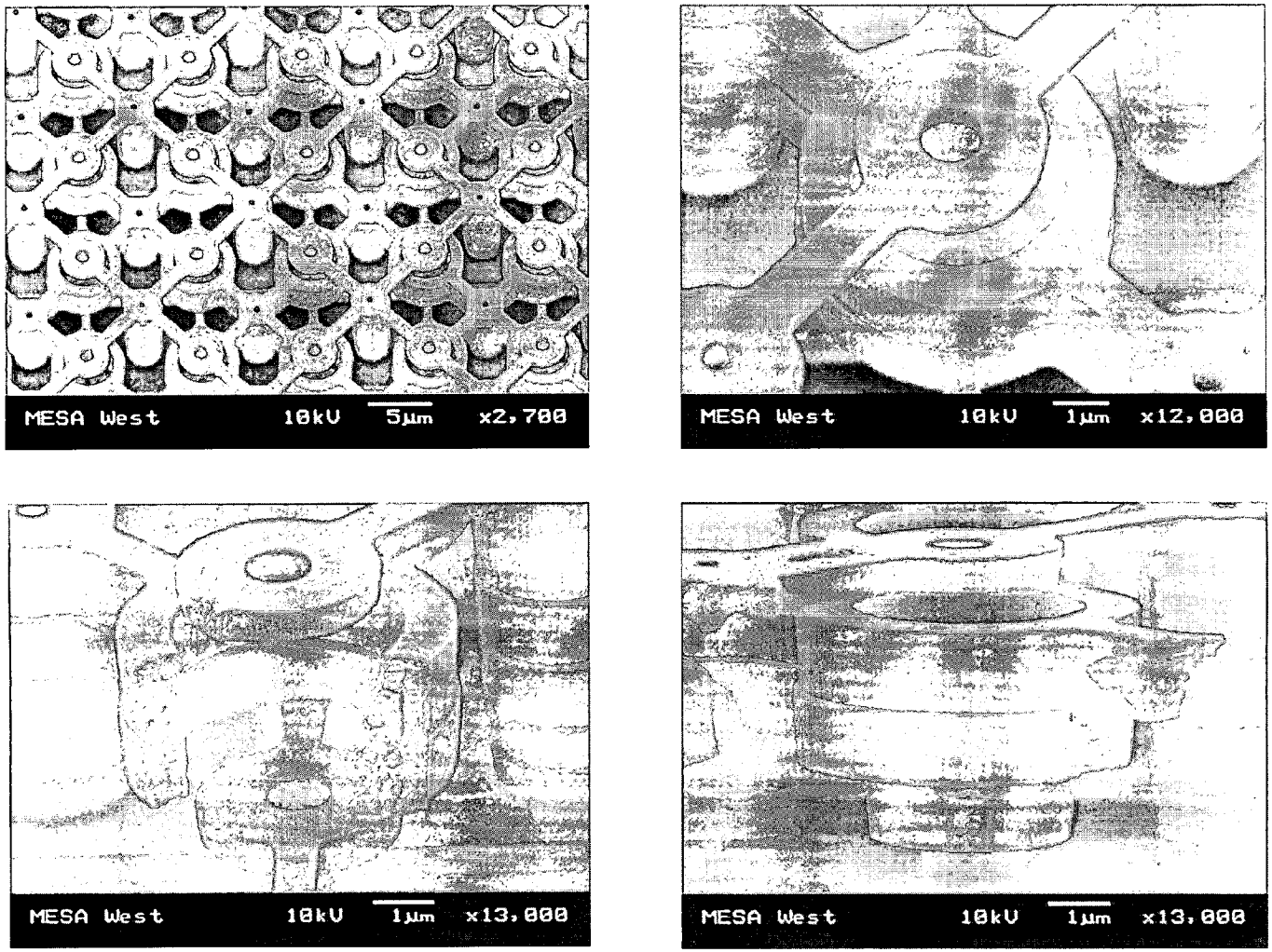

FIG. 15 shows scanning electron microphotographs (SEMs) of an array of microfabricated tungsten ion traps with trap radius of $r_0$=0.95 μm.

Figure 16:
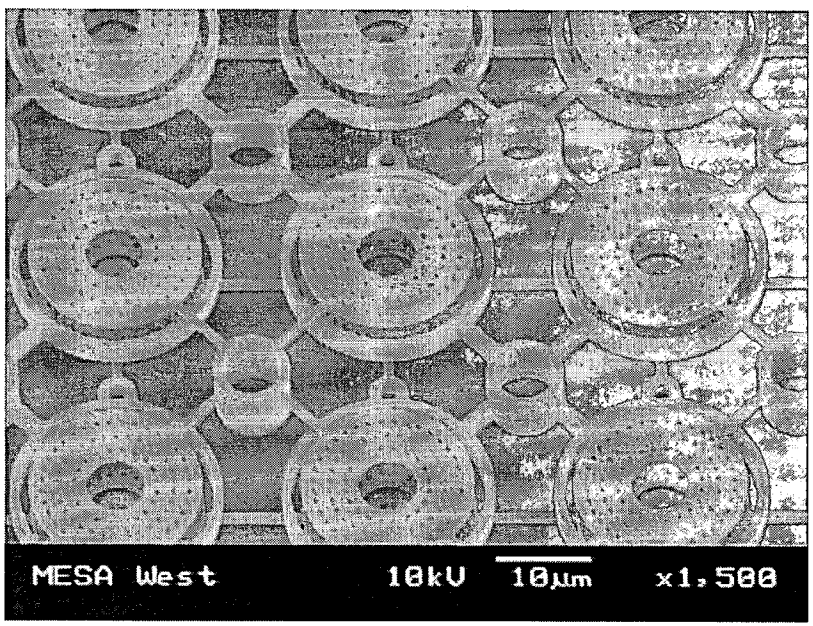
Figure 16:
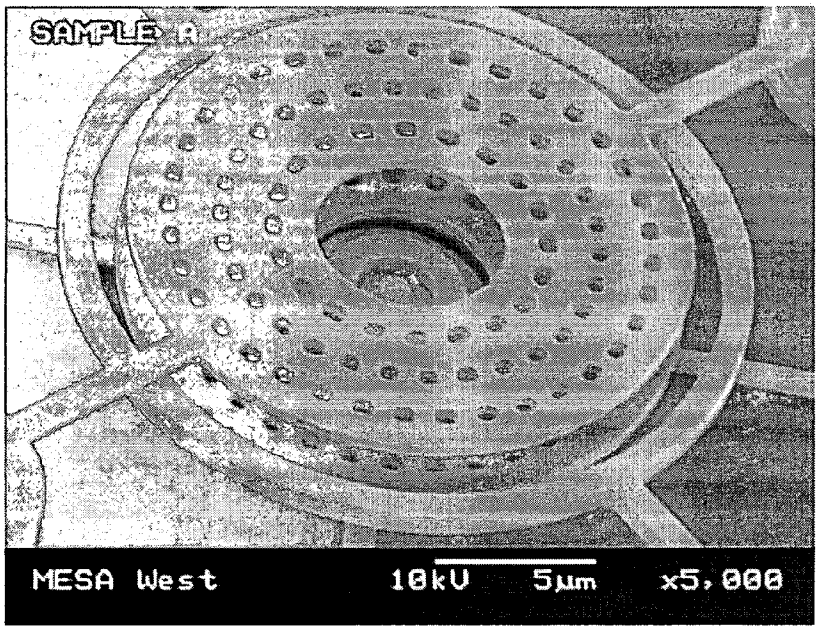

FIG. 16 shows shown SEMs of an array of microfabricated tungsten ion traps with a trap radius of about 10 μm.

DETAILED DESCRIPTION OF THE INVENTION

Figure 1:
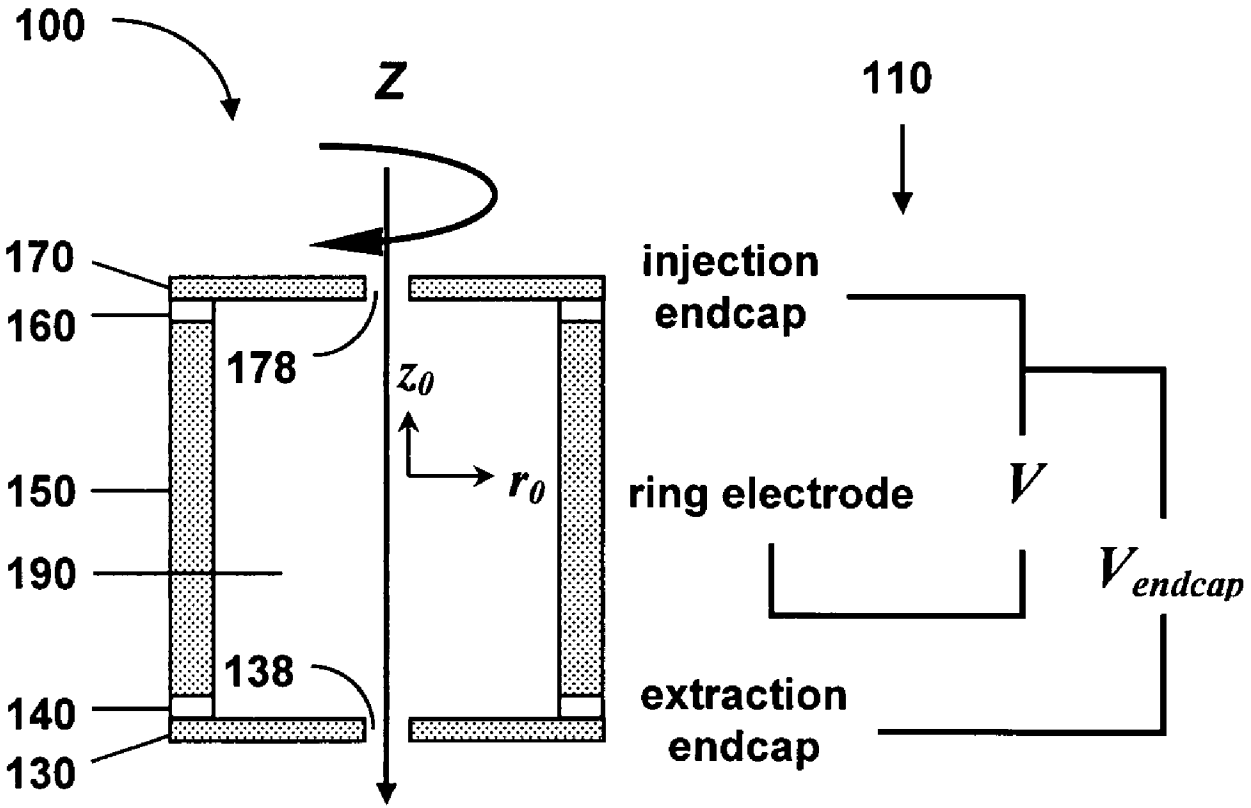
FIG. 1 shows a schematic illustration of a single cylindrical ion trap.

In FIG. 1 is shown a schematic illustration of a single CIT 100 comprising a cylindrical ring electrode 150, two planar endcap electrodes 130 and 170, and endcap dielectric spacers 140 and 160 between the center ring electrode 110 and the endcap electrodes 130 and 170. Ions are trapped in the intraelectrode trapping volume 190 defined by the cylindrical ring electrode 150 and the endcap electrodes 130 and 170. Apertures 178 and 138 can be provided in the endcap electrodes 170 and 130 for injection of a neutral or ionized sample gas into and ejection of the ions out of the trapping volume 190. The CIT 100 is rotationally symmetric about the axial Z axis. $r_0$ is the inner radius of the ring electrode 150 and $z_0$ is the center-to-endcap distance. The CIT 100 can be energized by a power source 110 that provides a rf drive voltage V between the ring electrode 150 and the endcap electrodes and a dc or rf voltage $V_{endcap}$ between the two endcap electrodes 170 and 130 for trapping of the ions. Direct current signals can also be applied to the ring electrode 150 for additional isolation of ions having a particular mass-to-charge ratio.

Ion Trapping in Microscale Traps

The voltage and frequency of a microscale ion trap can be chosen using the same criteria as a conventional ion trap: 1) the ion motion in the trap must be stable in both the r and z directions, and 2) the potential well must be large enough, compared to the initial energy of the ion, to trap it. Because of these criteria, the voltage of the microscale ion trap cannot be chosen arbitrarily small. The rf frequency of the microscale ion trap must be increased accordingly.

The ion motion in the trap must be stable. Ion trapping in the trapping volume arises from a quadrupolar potential well when appropriate voltages are applied to the electrodes. Ion motion in a quadrupole field can be described by solutions to the second order differential equations due to Mathieu. The solutions to the Mathieu equations define boundaries of stable and unstable regions of the Mathieu stability diagram. See R. E. March et al., *Practical Aspects of Ion Trap Mass Spectrometry, Vol. I: Fundamentals of Ion Trap Mass Spectrometry*, CRC Press (1995).

The mass analysis equation for a QIT, derived from the stable solutions to the Mathieu equation, is $$\frac{m}{z} = \frac{-8V}{q_z\Omega^2(r_0^2 + 2z_0^2)} \tag{2}$$

where V is the zero-to-peak voltage of the applied rf trapping potential, $q_z$ is the Mathieu parameter when the ion is ejected from the trap in the Z direction, Ω is the angular rf drive frequency, $r_0$ is the inner radius of the hyperboloid ring electrode, and $z_0$ is the center-to-endcap distance. For a perfectly quadrupolar field, the electrodes are arranged according to $r_0^2=2z_0^2$. Therefore, the axial Mathieu parameter for an ideal QIT (of hyperbolic geometry with endcaps grounded) is $$q_z = -\frac{4eV}{mr_0^2\Omega^2}. \tag{3}$$

Likewise, the radial Mathieu parameter for the ideal QIT is $$q_r = \frac{2eV}{mr_0^2\Omega^2}. \tag{4}$$

Successful trapping requires that the motion of the ions be stable (i.e., $q_r$, $q_z$<0.908). Similar solutions to the Mathieu equations are possible for the near-quadrupolar fields of the CIT using a pseudopotential approximation. In particular, optimum trapping conditions for the CIT often occur for a "stretched" trap geometry (e.g., $r_0^2=1.7z_0^2$).

In addition to operation at a working point in the stability region, successful trapping requires that the amplitude of the ion oscillation is limited to the size of the trap. At equilibrium, this is equivalent to the requirement that the axial and radial pseudopotentials are deep with respect to the thermal energy of the ion. The potential axial well depth $D_z$ for the ideal quadrupole geometry is given by $$D_z = -\frac{q_zV}{8} \tag{5}$$

See Dehmelt, H. G., "Radiofrequency Spectroscopy of Stored Ions I: Storage," *Adv. Atom. Mol. Phys.* 3, 53 (1967). For the ideal QIT, the axial well depth is twice the radial well depth.

The mass analysis equation, Eq. (2), indicates that, for fixed operating parameters, a decrease in the dimensions of the ion trap (i.e., $r_0$ and $z_0$) causes ions of higher m/z ratio to be trapped. Alternatively, Eqs. (3) and (4) indicate that, for a given m/z ratio, a reduction in the trap size requires that either the rf amplitude (V) be decreased quadratically (for a constant Ω) or that the rf frequency be increased linearly (for a constant V) with the dimension of the trap, $r_0$, to maintain stable trapping. A reduction in the rf amplitude is desirable, as it simplifies electronics for trap operation thus allowing a reduction in the size and complexity of not only the mass analyzer but also the whole instrument. However, for orders of magnitude decrease in trap size, the rf frequency must also be increased and hence microscale ion traps are preferably operated in the GHz regime. A practical consequence of this is that the size of a microfabricated ion trap array must be smaller than the wavelength of the rf field to avoid a voltage drop across the array.

Figure 2:
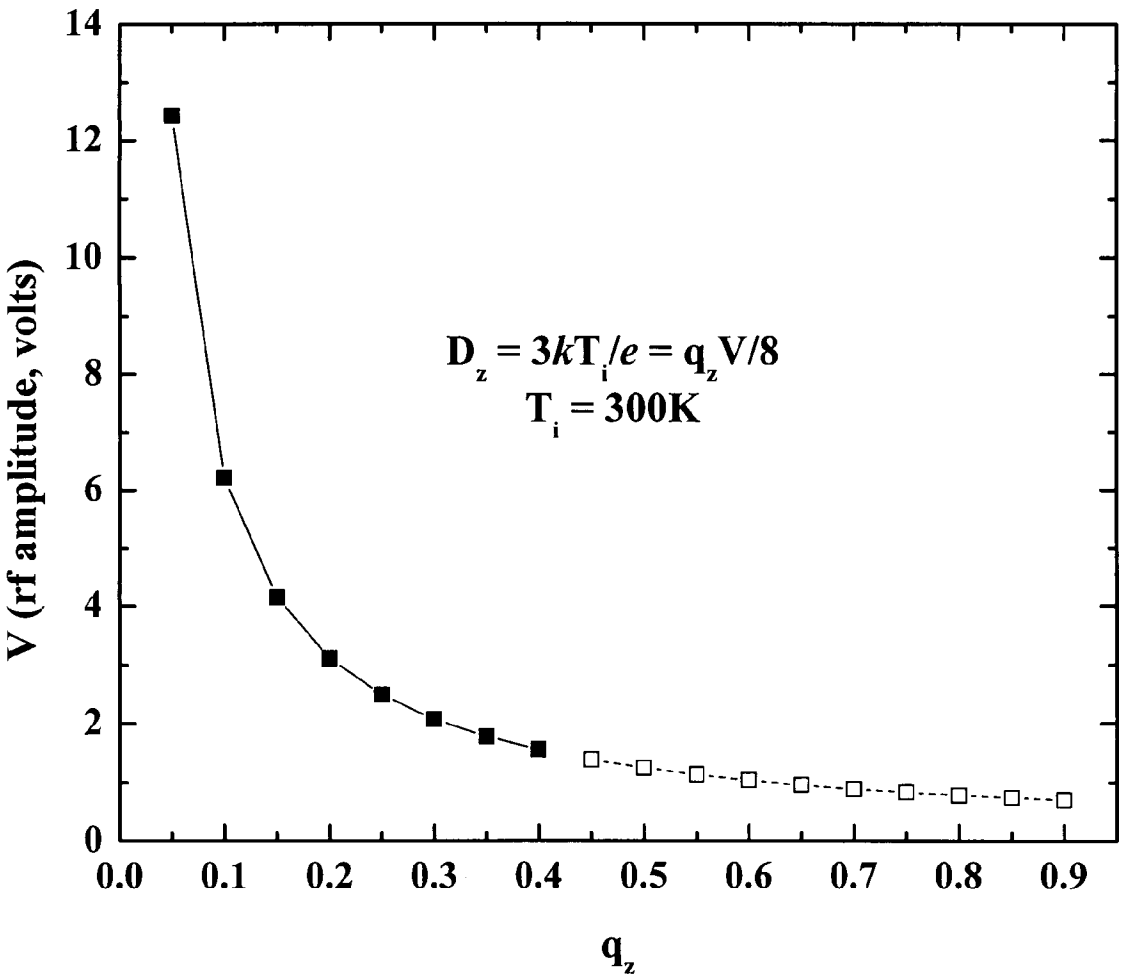
FIG. 2 shows a plot of the minimum ring voltage V as a function of $q_z$ for the trapping of ions having initial energy equal to $eD_z=3\ kT_i$ at 300 K. For values of $q_z<0.4$, the Dehmelt approximation holds. Values for $q_z>0.4$ are less certain.

It is clear from Eq. (5), however, that the depth of the pseudopotential well is independent of the trap size, depending only on q and V. Consequently, a reduction of the rf amplitude leads to a reduction of the well depth for the microscale trap. If the pseudopotential well is reduced to a point where its depth is of the order of the initial ion kinetic energy, ions will be lost from the trap by hitting the electrodes, even if their motion is stable, and the trapping efficiency will be reduced. Thus when the pseudopotential is of order 3 kT, ions begin to be lost. In FIG. 2 is shown a plot of V versus $q_z$ for the condition $D_z=3\ kT_i/e=Vq_z/8$ with $T_i=300$ K. This plot shows that for ion trapping in a microscale ion trap, the rf amplitude cannot be made arbitrarily small.

An alternative description is that the spatial spread of the ions is essentially determined by the ratio of the ion kinetic energy to the well depth, $kT_i/eD$. Thus, a reduction in the pseudopotential leads to an increased spatial spread of the ions. One consequence of this for mass analysis with macroscale traps is that during mass-selective instability scans an increased spatial spread causes an increased spread in ejection times, leading to a decreased mass resolution of the trap.

Therefore, to maintain the performance of a microscale ion trap at a level comparable to that of a full-size trap, the rf frequency must be increased as the trap dimensions are reduced. Since, apart from collision effects, the ion motion in rf traps scales with the rf frequency, the increase in rf frequency has the advantage that the speed of the rf scan can be increased proportionally. Hence, the duration of the rf scan could be maintained at the same time as for a full-size trap, with an increased mass resolution resulting from the effectively slower scan. Furthermore, as the rf frequency is increased, the pressure tolerance of the trap increases by the same factor.

As the trap size is reduced with respect to full-size traps, it is generally not practical to exclusively decrease the rf amplitude quadratically (leaving the frequency constant) nor exclusively increase the rf frequency (leaving the amplitude constant). Rather, it generally preferable to compromise between performance and simplification of electronics: the rf amplitude is decreased to moderate values while the frequency is raised, such that ions can still be trapped if they are in equilibrium with the buffer gas. The effectively slower scan caused by the simultaneous increase in rf frequency tends to compensate for the loss of mass resolution resulting from the reduced pseudopotential well depth. If the rf amplitude is reduced even further, below values for which the pseudopotential is of the order of 3 kT, the only way to still ensure trapping is to operate the trap essentially without buffer gas. This is equivalent to the condition where the measurement repetition frequency is larger than the mean ion-neutral collision frequency.

The well depth has been calculated for both full-size (1 cm) and microscale (1 μm) ion traps using a code that simulates electric fields and ion motion in these traps. See M. G. Blain et al., "Towards the hand-held mass spectrometer: design considerations, simulation, and fabrication of micrometer-scaled cylindrical ion traps," *Int. J. Mass Spectrometry* 236, 91 (2004). These simulations indicate that a microscale ion trap will achieve only small well depths and therefore hold very few ions. An important operational consequence of such shallow well depths is that in-situ ionization is preferred. For rf driven traps, it is known from a large literature on the subject that ion injection velocity, rf phase angle, $q_z$ value and collisions with a buffer gas will affect the ion injection efficiency for externally created ions. See R. E. March et al. In conventional sized traps, the maximum kinetic energy defined by the well depth is large relative to the kinetic energy of injected ions and the effects of collisional cooling allow trapping of a significant fraction of the injected ions, efficiencies being on the order of a few percent. Upon injection into a microscale trap, however, externally created ions may have a considerable kinetic energy with respect to the well depth. Consequently, the efficiency for trapping externally injected ions with a microscale trap is very small.

Space Charge, Maximum Storable Charge, and Spectral Charge Limits in Microscale Ion Traps Space charge effects can significantly limit the performance of an ion trap mass spectrometer, including resolution, mass accuracy, sensitivity and dynamic range. See J. C. Schwartz et al., *J. Am. Soc. Mass. Spectrom.* 12, 659 (2002). For mass spectrometry, there are several types of space charge limits. The two most relevant for microscale traps are the ion storage space charge limit, $N_{max}$, and the spectral space charge limit, $N_s$. $N_{max}$ is the maximum total number of ions that can be stored in a trap based on space charge limitations, while $N_s$ describes the maximum number of ions which can be stored while maintaining the ability to record a mass spectrum of some specified resolution and mass accuracy. Consequently, $N_{max}$ at represents the upper physical limit for the number of charges which may be trapped while $N_s$ represents the critical limit for applications of mass analysis, where resolution and mass accuracy are of most relevance. $N_s$ is typically orders of magnitude smaller than $N_{max}$, although both depend on the operating conditions and physical characteristics such as operating frequency and physical size, and the analytical criteria set for generating a mass spectrum.

From Dehmelt, the maximum total ion number $N_{max}$ per trap based on space charge limitations is given as $$N_{\max} = \frac{(4\pi\varepsilon_0)4D_z z_0}{e} = 2.8\times10^7 D_z z_0 \text{ ions/trap} \tag{6}$$

$N_{max}$ has been calculated for ideal traps (hyperbolic with $r_0^2=2z_0^2$) of radius 1 cm, 2.5 mm, and 1 μm, using $q_z=0.3$ and representative rf amplitudes. The relevant trap volume is assumed to be a rotated ellipsoid filling the trap, such that $V_t=(2\sqrt{2}/3)\pi r_0^3$. The results show that for a full-size Paul ion trap (with $r_0=1$ cm) $N_{max}$ is $2\times10^8$ ions, while an ideal 1-μm trap is limited to a maximum storable ion number of about 200, six orders of magnitude smaller than the full-size trap.

At the same time, the spectral limit for the full-size Paul ion trap has been estimated by Schwartz et al. to be $N_s \sim 10^5$ ions. Using volume scaling, the minimum volume in which two ions may be contained without exceeding the spectral limit is approximately $5\times10^{-5}$ cm$^3$, which is seven orders of magnitude larger than the volume ($3\times10^{-12}$ cm$^3$) of the 1-μm trap. Therefore, the spectral space charge limit will be exceeded for a microscale trap with more than one ion.

A spectral space charge limit of one ion per trap results in a loss in signal intensity (i.e., sensitivity) for applications in mass analysis. One method to regain storage capacity and increase sensitivity is to use a parallel array of microscale traps. Ions can be stored under the same conditions in multiple, identical ion traps with the same $r_0$ arranged in a parallel array and then scanned out simultaneously to a single detector. A storage efficiency of one percent in an array of $10^6$ traps would store $\mathbf{10^4}$ ions, a single ion in each of $10^4$ traps. Furthermore, the presence of only one ion per trap may give rise to interesting phenomena for mass spectrometry in that there are no effects from space charge. For example, the careful control of trap pressure combined with trapping a single ion may allow for new experimental capabilities in the study of ion/molecule reactions.

Trapping Fields in Microscale Traps

The exact nature of the trapping fields in an ion trap is a crucial factor, since the ion behavior depends directly on the potential distribution and thus the field strength. For the ideal quadrupole ion trap, the electric field in the axial (Z) dimension increases linearly with displacement from the center. However, the existence of endcap apertures (necessary for ion/electron injection and ion ejection) introduces negative higher order field components. Such non-linear fields degrade the ideal field linearity and cause rf heating and de-stabilization of trapped ions, consequently affecting trapping efficiency and storage time.

Among the higher order fields, of most interest are the octopole field ($A_4$) and dodecapole field ($A_6$) since the weights of other higher order fields are normally very small. The deliberate introduction of a positive higher order field (in most cases octopole field) to some extent compensates for the unavoidable negative higher order field (in most cases dodecapole field) and reduces the time over which ion ejection occurs. For a commercial quadrupole ion trap, positive octopole fields are introduced intentionally by either stretching out the endcaps in the axial direction or by modifying the hyperbolic angle of the endcaps.

Figure 3B:
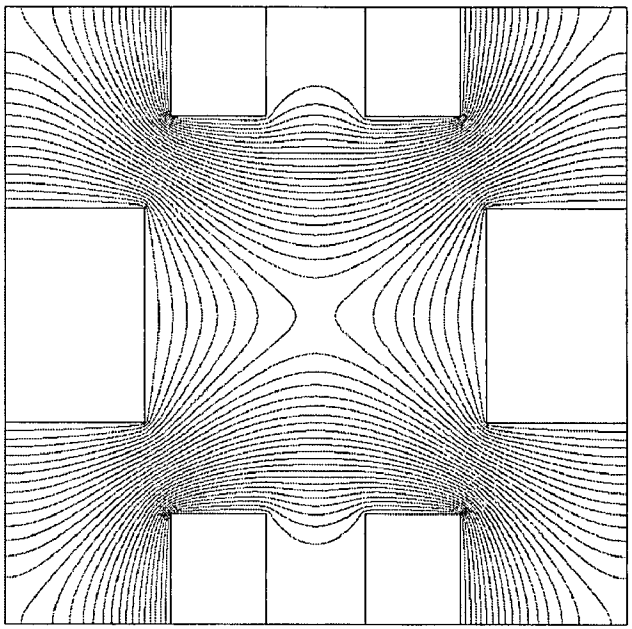
FIG. 3B shows the calculated potential distributions inside the microscale CIT.
Figure 3A:
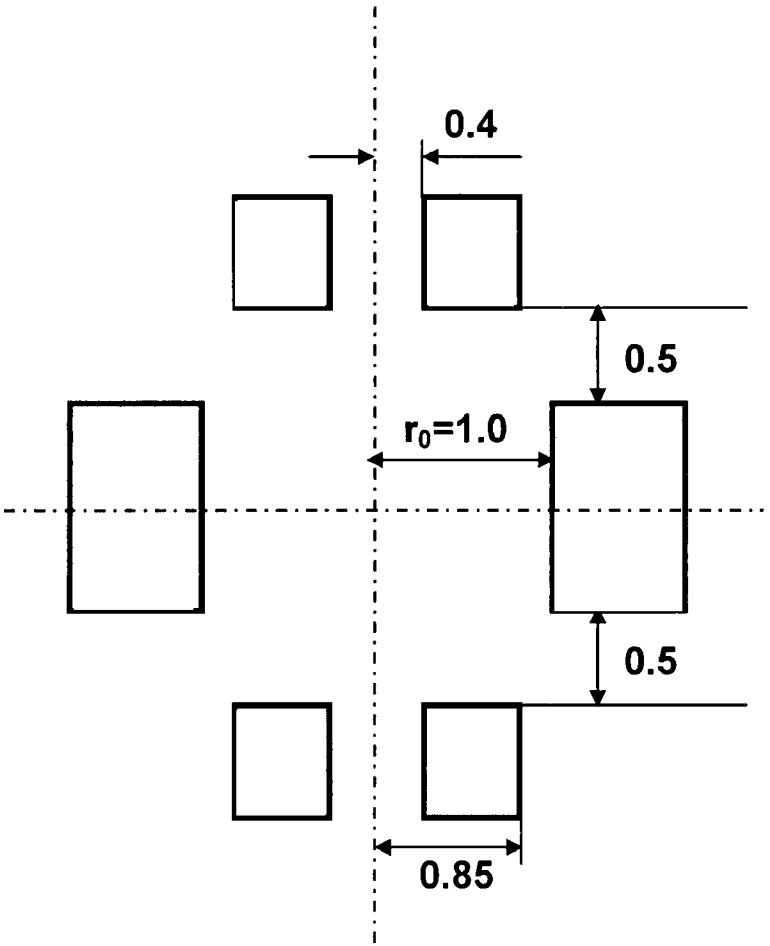
FIG. 3A shows a cross-sectional schematic illustration of a microscale CIT of dimension $r_0=1$ μm, with endcap apertures and spacing between the endcaps and ring electrode.

Consider the geometry of a microscale CIT with an inner ring electrode radius $r_0$=1.0 μm and two endcaps each having a central hole with radius of approximately 0.4 μm. This geometry is shown in FIG. 3A. Potential distributions inside the microscale CIT calculated using a simulation code are shown in FIG. 3B. The high-order fields for this geometry, represented by multipole expansion coefficients, were also calculated. For the microscale CIT, the values for the field coefficients are $A_2$=0.628, $A_4$=0.050 and $A_6$=−0.101. The normalization radius used was 1 μm. The positive non-linear octopole field ($A_4$) partially compensates for the negative dodecapole field ($A_6$), therefore enabling rapid ejection of ions from the trap and maximum mass spectral resolution.

Figure 4:
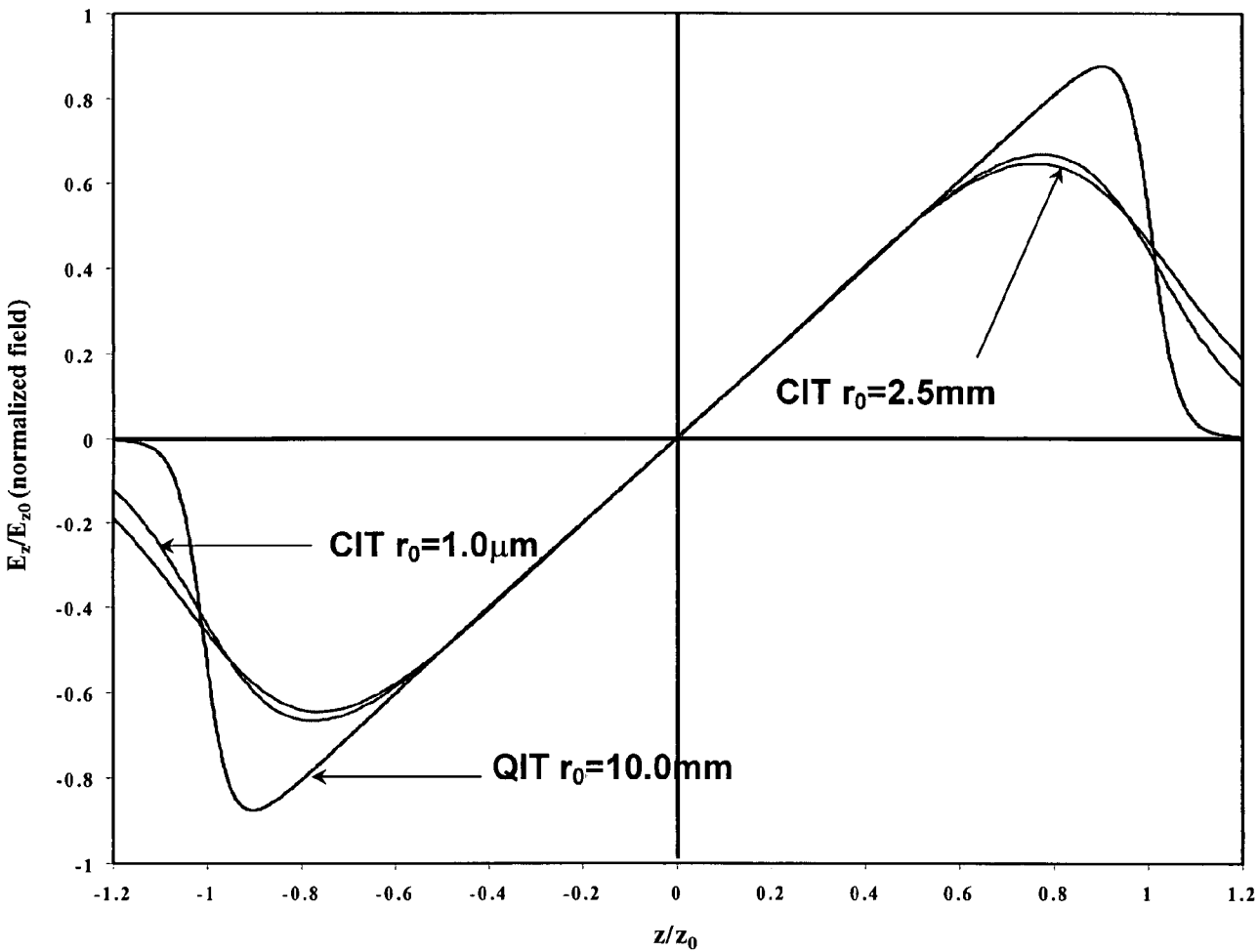
FIG. 4 shows a plot of the calculated total axial electric field on-axis as a function of the normalized axial position ($z/z_0$) for a full-size (1 cm) commercial hyperbolic trap, and 2.5-mm and 1-μm CITs.

The resulting total axial electric field (on axis) is plotted as function of the normalized axial position ($z/z_0$) in FIG. 4. Ideally, this plot would show a linear field region throughout the entire trap until $z/z_0$=1, at which point the field should drop abruptly to zero (a vertical line at this value). As FIG. 4 shows, the microscale trap has a large region where the field is linear, but deviates from linearity at about $z/z_0$=±0.6. The full-size, 1-cm ion trap has a steep but non-instantaneous drop from the field region to the field free region with the non-linear field region beginning at $z/z_0$=±0.95. The non-linear regions close to the edges of the field region can cause ejection delays as ions oscillate in the lower field region, due to their becoming sequentially stable and instable as $z/z_0$ position changes. This causes shifts in mass peak positions and loss of mass resolution. The commercial QIT trap has been stretched to introduce positive higher-order fields to correct for the ejection delay.

Trajectories, Spatial Dispersion, and Ion Loss in Microscale Traps

Figure 5B:
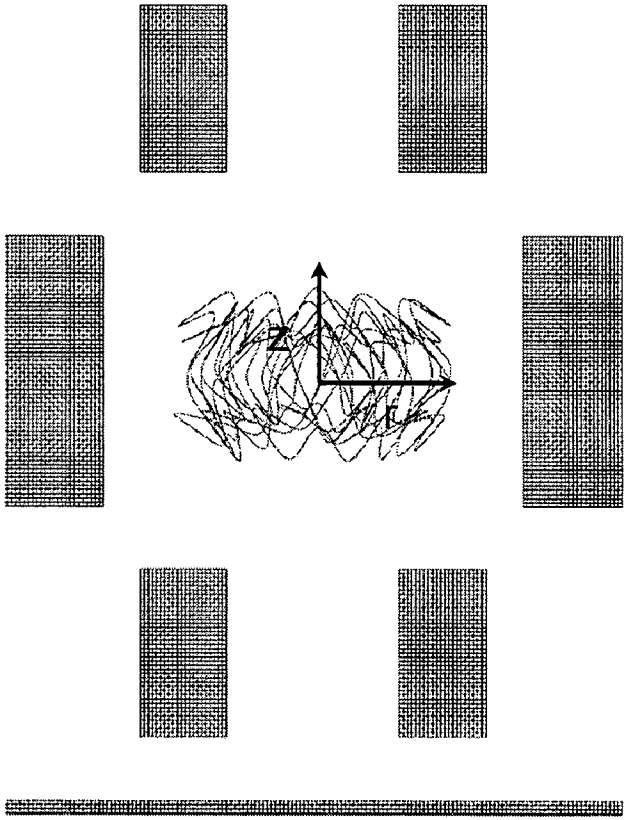
FIGS. 5A and 5B show ion trajectory simulation results in the axial and radial directions, respectively, for a single trapped ion in a microscale (1 μm) CIT with m/z=93, V=8 V, and Ω=1.2 GHz. Trajectories follow typical Lissajous curves and encompass a large volume of the trap.
Figure 5A:
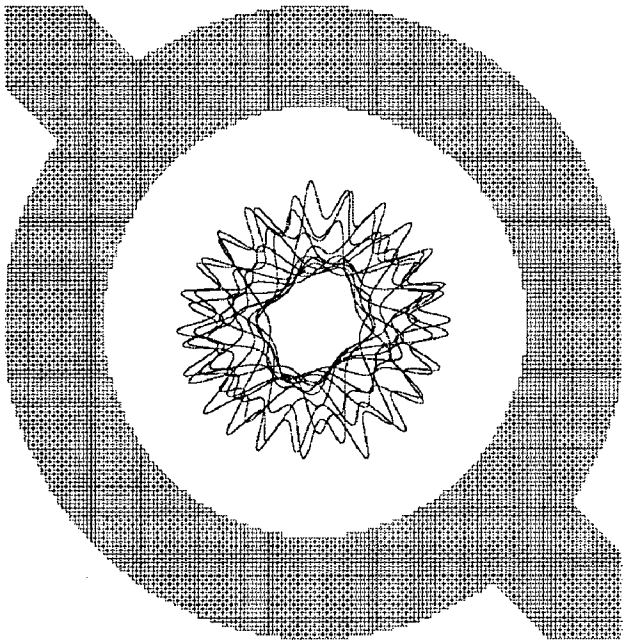

Ion trajectories in microscale CITs were simulated and, as in standard sized ion traps, the trajectories of trapped ions in a microscale trap follow a typical Lissajous pattern. Axial and radial (side) views of this pattern are illustrated in FIGS. 5A and 5B. This is the trajectory for a single ion, rather than a cloud of many ions, and the trajectory radius is large with respect to the trap dimension.

The spatial dispersion of trapped ions may be expressed by one of two methods: (1) the average dispersion of the total ion cloud consisting of many ions, or (2) the average value of the volume occupied by a single ion. The appropriate method depends on the timescale of interest. It has been observed via simulation that if a cloud of many ions is created randomly over a few rf cycles in a single 1-μm CIT (i.e. a non-ideal trap), ion losses are rapid. The ions will down-select to a single trapped ion within a few microseconds (with Ω~1 GHz) due to space charge induced anharmonicities and subsequent rf heating and destabilization of ions that are off-center. For an ideal hyperbolic 1-μm trap, down-selection to one ion also is observed. However, the timescale for this process is a factor of 5–10 times longer than for the CIT. For full-size (1 cm) traps, ion loss processes and down-selection to a single trapped ion occurs on the order of milliseconds.

Figure 6:
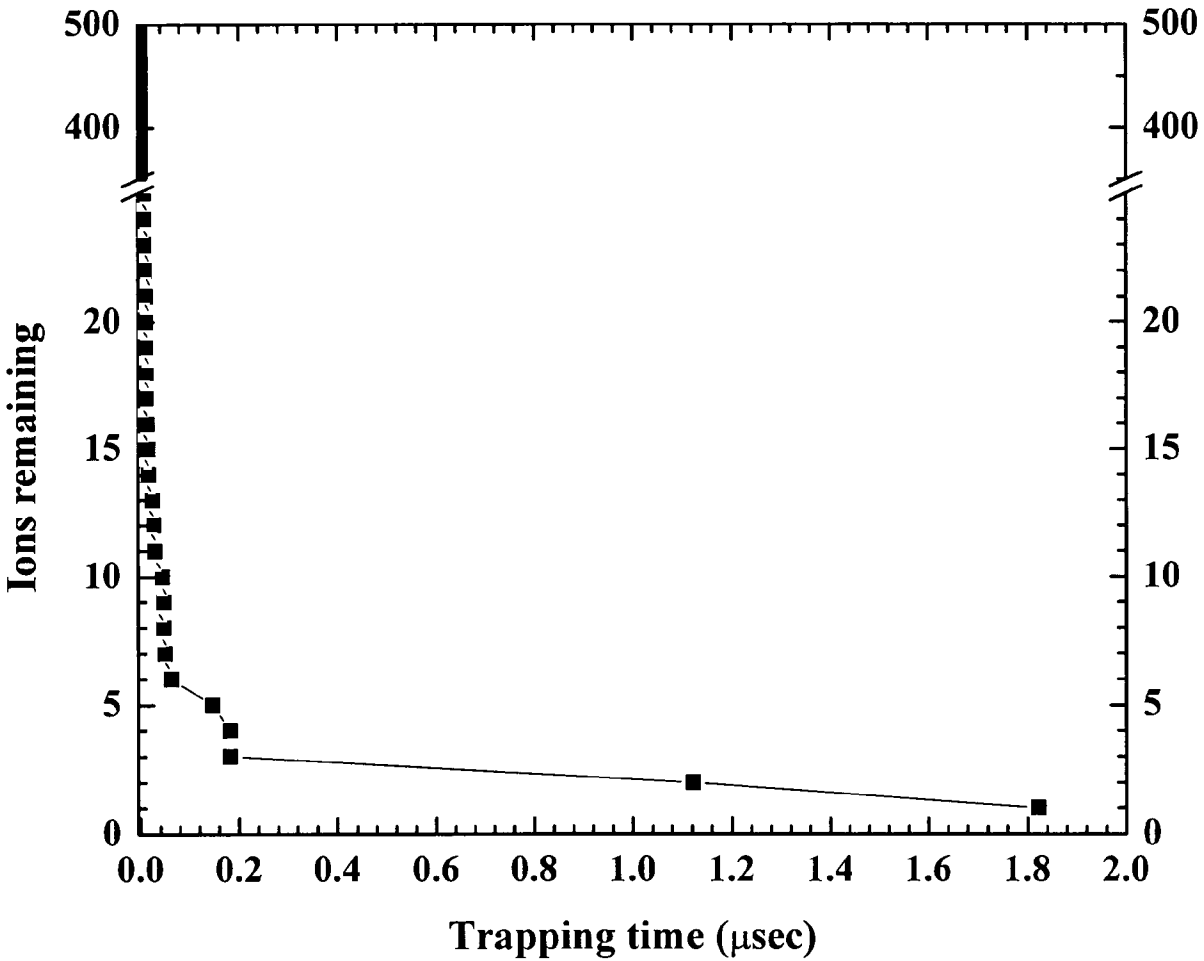
FIG. 6 shows a plot of the simulation results of ion number versus time for a cloud of 500 ions (m/z=93, V=8 V, and Ω=1.2 GHz, $T_i$=300 K, no collisions with neutrals) undergoing space charge repulsion and started randomly over one rf cycle in a microscale CIT. Within 150 rf cycles, 99% of the ions are lost and only one ion remains after 1.8 μs.

The ion loss process in a microscale (1 μm) CIT is shown in FIG. 6. The plot shows ion number versus time for a cloud of 500 ions (m/z=93, 8 V, Ω=1.2 GHz, $T_i$=300 K, no collisions with neutrals) undergoing space charge repulsion and started randomly over one rf cycle. Within 150 rf cycles, 99% of the ions are lost, and only one ion remains after 1.8 μs. Consequently, for the microscale trap, the average value of the volume occupied by a single ion is a more accurate definition of ion dispersion volume than the volume of an ion cloud changing rapidly in ion number because of the short down-selection times. For the microscale CIT operated under the above conditions, the shape of the volume occupied by an ion is that of a cylinder and is about 7% of the trap volume. For a microscale CIT, the increased volume occupied by a trapped ion with respect to the volume of the trap due to the lower rf voltage results in ions experiencing greater field nonlinearities and therefore destabilizing more rapidly.

Figure 7:
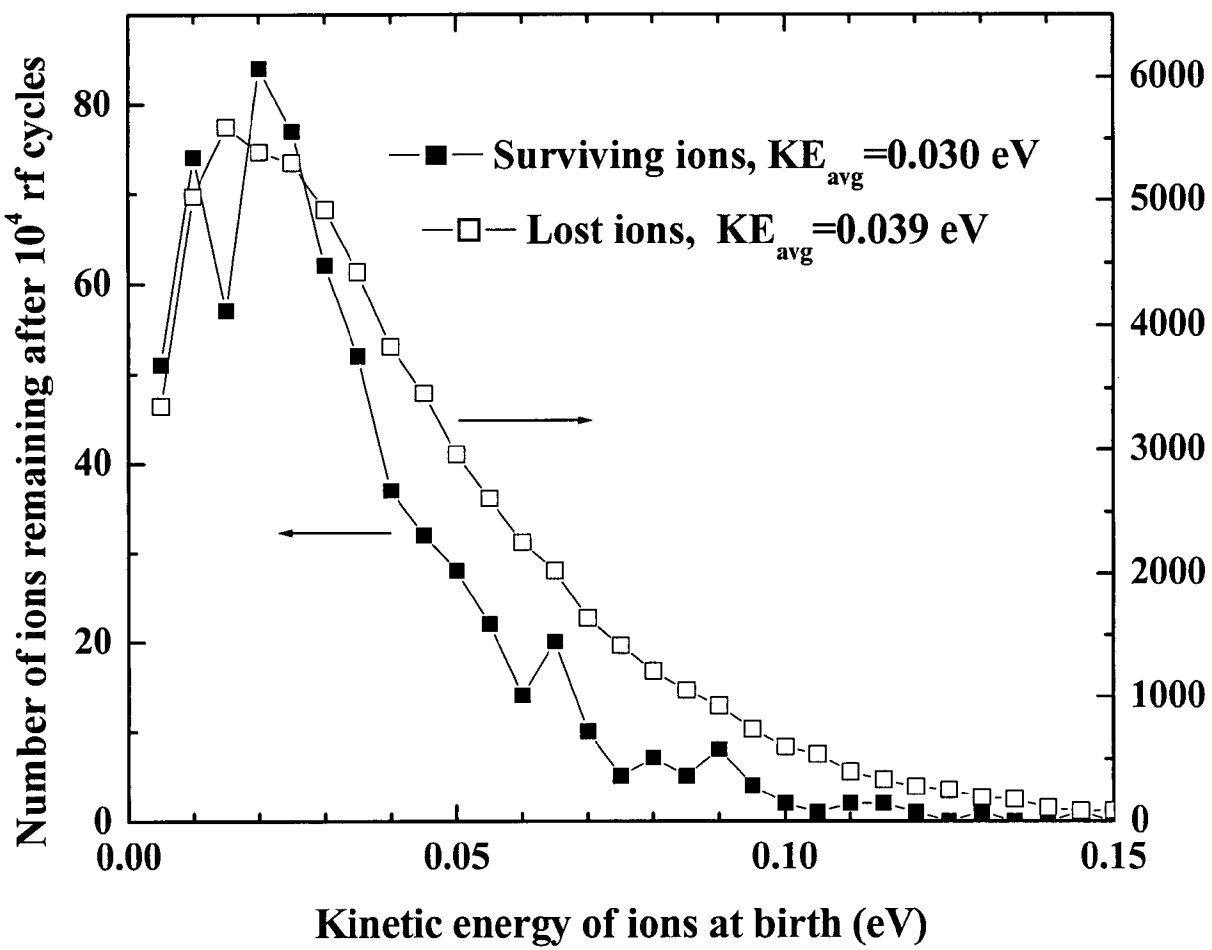
FIG. 7 shows a plot of simulation results of initial kinetic energy for lost and surviving ions in a total of 620 instances of ion trapping for $10^2$ ions (m/z=93, V=8 V, and Ω=1.2 GHz, $T_i$=300 K) undergoing no collisions with neutrals for a trapping time of 104 rf cycles (8.3 μs) in a microscale CIT. The average starting kinetic energy of the 660 surviving ions (40 instances had two ions remaining after 8.3 μs) was $KE_s$=0.030 eV. The average starting kinetic energy of the 61,440 lost ions was $KE_L$=0.039 eV.

Initial kinetic energies of ions are no longer negligible with respect to the pseudopotential well depths for microscale traps. FIG. 7 shows frequency plots of initial kinetic energy for lost and surviving ions in a total of 620 instances of ion trapping for $10^2$ ions (m/z=93, 8 V, Ω=1.2 GHz, $T_i$=300 K) undergoing no collisions with neutrals for trapping time of $10^4$ rf cycles (8.3 μs). The average starting kinetic energy of the 660 surviving ions (40 instances had two ions remaining after 8.3 μs) was $KE_{s=}0.030$ eV. The average starting kinetic energy of the 61, 440 lost ions was $KE_L$=0.039 eV. These results show that ions having favorable starting properties (in terms of position, velocity, and rf phase value) are more likely to survive than ions having unfavorable starting conditions. For example, an ion starting close to the trap center with energy less than kT is, on average, more likely to be trapped than one starting well off-center with energy greater than kT. A more complete picture would be obtained by also comparing the positions and the velocity vectors of the lost and surviving ions, however it is the convolution of all three input factors—position, velocity, and phase—with the space charge environment and field anharmonicities that induce the rf heating and subsequent loss of an ion. It is clear that the larger ratio of the ion kinetic energy to the pseudopotential well depth, $kT_i/eD$, for a microscale trap with respect to a full-size (1 cm) trap is a defining factor for trapping behavior.

These results suggest that the following important factors influence ion loss in microscale ion traps:

(a) Initial position and velocity of each ion relative to the RF phase: depending on the initial conditions the ions have oscillation amplitudes of different magnitude and may or may not be trapped. Here, the trapping efficiency depends on $q_z$ and is observed to be up to 50% at very low $q_z$ and near 0 at high $q_z$ because of the rf ripple on the ion oscillation. This effect is independent of well depth for cool ions, but ions are additionally lost if the well depth is of the order of the kinetic energy or lower. The time for ejection is about one secular cycle.

(b) Collisions: collisions with a light buffer gas increase the trapping efficiency if the pseudopotential well depth is much larger than the kinetic energy of the ions in equilibrium with the buffer gas, but lead to almost complete ion loss if the well depth is of the same order as kinetic energy.

(c) Space charge: ions are lost if the space charge potential from the presence of multiple ions is larger than the pseudopotential. In addition, if the ion—ion collision frequency is of the order of the ion-neutral collision frequency or higher, rf heating dominates and ions are lost over time.

(d) Ion trap geometry: the shape of the pseudopotential well and its depth in the axial and radial directions is determined by the geometry of the trap electrodes and influence the ion trajectory and consequently the trapping time.

Trapping Efficiency

The efficiency of trapping ions in a microscale trap was studied via simulation. Trapping efficiency is defined as the fraction of ions remaining in a trap, $\epsilon=n_t/n_0$, where $n_0$ is the number of ions in the trap at some time t=0 and $n_t$ is the number of ions remaining after time t. For a typical condition of helium at 1 mTorr in a full-size trap, ionization occurs over a time period of 1–10 ms and the ion cloud cools to the center of the trap within a few milliseconds. Longer cooling periods, up to 100 ms, are needed to maximize the detected ion signal as He pressures are reduced below 1 mTorr. The relevant timescales for defining trapping efficiencies of full-size traps, therefore, are on the order of 1 to 10 ms, with t=0 being the end of the ionization process. For microscale traps it was shown above that ion loss processes cause down-selection of the original ions to a single remaining ion very quickly, typically within a few microseconds for the case of a CIT and within a few tens of microseconds for an ideal (hyperbolic) trap. A certain fraction of these surviving ions can then remain trapped for times on the order of milliseconds in vacuum, however they also are eventually lost.

For simulation results presented here the following conditions were imposed: (1) trapping of single ions was followed (i.e. no space charge effects); (2) ions were created assuming ionization of a neutral with random location, direction, and phase angle inside the trap and initial kinetic energies equal to that of the neutral gas temperature over the entire ionization volume, viz. the cylinder defined by the endcap apertures; and (3) the cut-off time upon which ions were designated as being trapped was 2000 rf cycles after ion creation (1.8 μs for a 1.2 GHz drive frequency).

Figure 8:
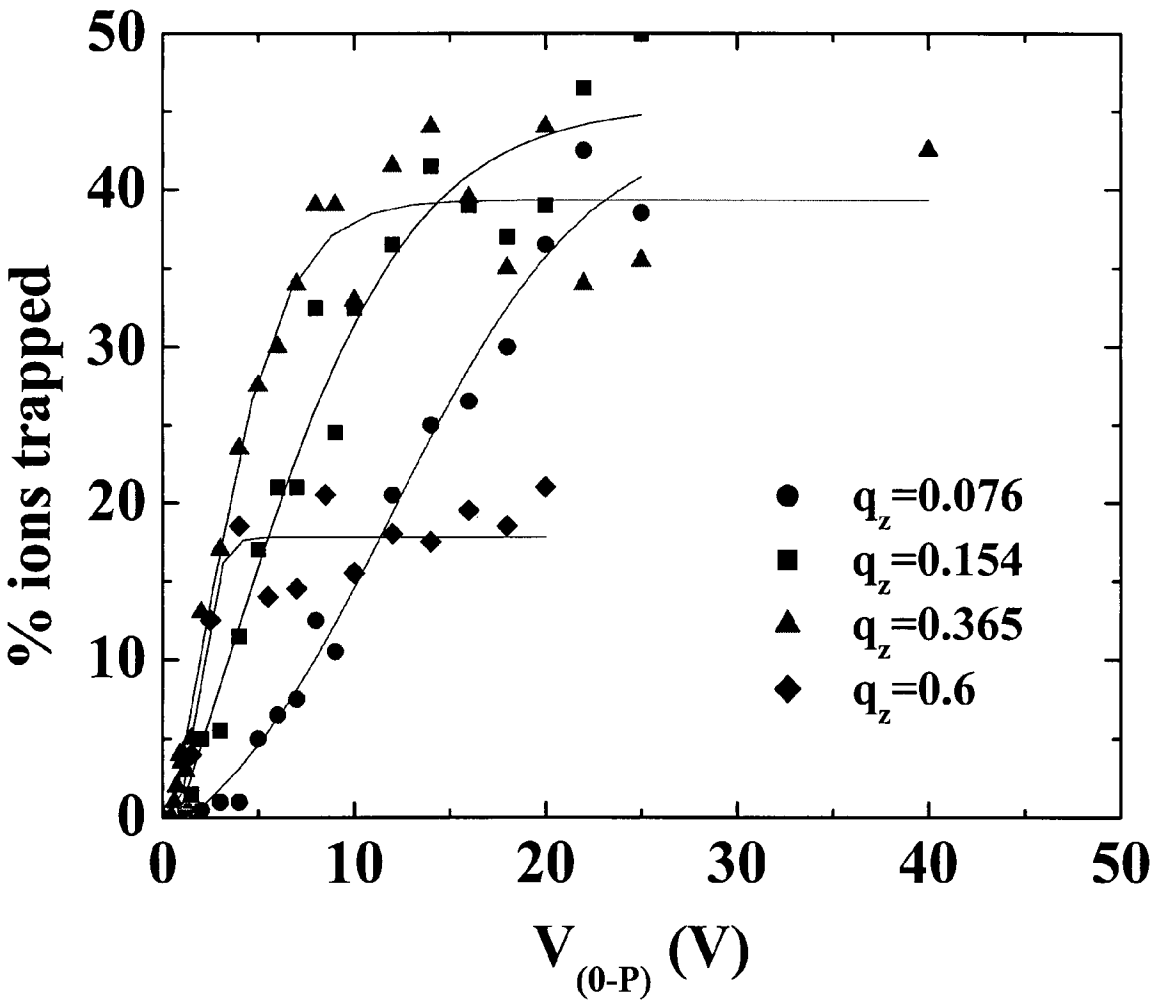
FIG. 8 shows a plot of simulation results for percent ions trapped (m/z=93) as a function of voltage for $q_z$ values of 0.076, 0.154, 0.365, and 0.6.

With these starting conditions, trapping efficiencies as a function of rf amplitudes, trap temperatures, and pressures were determined based on 250–1000 ion trapping events for m/z=93 ions. The correlation between trapping efficiency for m/z=93 and voltage at constant $q_z$ values of 0.076, 0.154, 0.365, and 0.6 was studied and results are presented in FIG. 8. As expected, trapping efficiency increases with increasing voltage. However, there exists a saturation point for $q_z$ values greater than 0.3. Although the pseudopotential well is increasing, the same percentage of ions remain trapped. That is, above a certain rf voltage the trapping efficiency remains nearly constant. Moreover, lower $q_z$ values show greater efficiencies at higher voltages. A $q_z$ value of 0.365 provides a trapping efficiency of nearly 40% at about 8 V. Increasing the voltage in this case would result in increased power consumption but would not improve trapping efficiency.

Figure 9:
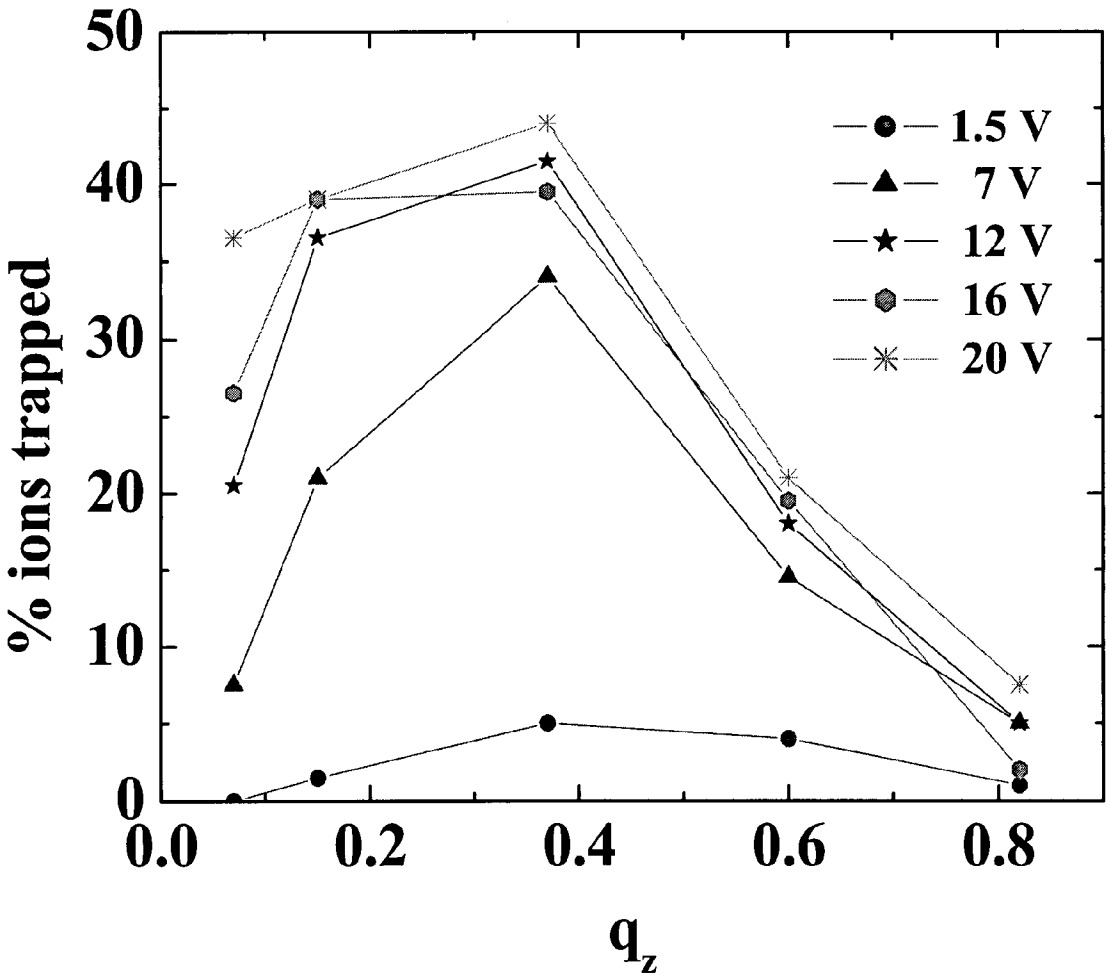
FIG. 9 shows a plot of simulation results for percent ions (m/z=93) trapped as a function of $q_z$ at 1.5, 7, 12, 16, and 20

As with all ion traps, potential well depth and thus trapping efficiency is dependent on $q_z$. Therefore, under a given set of trapping parameters (V and Ω) trapping efficiency is mass-dependent and there is a low mass cut-off ($q_z$~0.908) and an effective high mass cutoff as a maximum trapping efficiency occurs around $q_z$=0.4. In FIG. 9 is shown trapping efficiency as a function of $q_z$ for thermal ions with m/z=93 in a microscale trap with various rf amplitudes, 1.5, 7, 12, 16, and 20V. Note that in this plot frequency varies with the voltage to maintain a particular $q_z$ value for the mass of interest (m/z=93).

Given the physical and electrical properties of a microscale ion trap, some resistive heating of the electrodes and hence of the buffer gas and ions may occur. Due to the shallow pseudopotential well of a microscale trap operating at modest voltages, ion behavior and trapping efficiency may depend strongly on trap temperature. In FIG. 10 is shown the results of simulations of ion trapping efficiency for m/z 93 ions at various temperatures ranging from 200 to 500 K. Trap rf voltages of 8, 16, and 24 V were studied, and the rf frequency was varied so that $q_z$ was held constant at 0.4. The helium buffer gas was kept at a constant number density of 322 atoms per cubic micrometer, corresponding to a pressure of 1 Torr at 300 K. As expected, trapping efficiency is greater at lower temperatures and higher rf voltages.

The effect of buffer gas pressure was also examined using simulations. In FIG. 11 is shown the trapping efficiency as a function of helium pressure at various temperatures and rf voltages (again the rf frequency was varied so that $q_z$ was held constant at 0.4). Increasing pressure from 1 mTorr to several Torr has a large detrimental effect on trapping when the trap is operated at 8 V, but the effect is reduced as the voltage increases. In fact, when the trap is operated at 24 V, pressures up to 10 Torr have no noticeable effect on trapping efficiency.

Microscale Ion Trap

In FIG. 12 is shown a schematic cross-sectional side view of a single microscale ion trap 200 of a microfabricated ion array 300 of the present invention. The ion trap 200 comprises a center ring electrode 250, a top endcap electrode 270, and a bottom endcap electrode 230 on an insulating substrate 280. When used for mass analysis, the ion trap 200 can further comprise a Faraday-type ion collector 210. The ring electrode 250 is preferably cylindrically symmetric about a Z axis, although a near-hyperbolic ring electrode can also be fabricated with the layer-by-layer process described below. The endcap electrodes preferably have an axially symmetric disk shape, although the endcap electrodes can have a near-hyberbolic shape also. Therefore, the cylindrical hole of the center ring electrode, along with the endcap electrodes, define an intraelectrode trapping volume 290. The radial dimension $r_0$ and axial dimension $z_0$ of the trapping volume 290 can be adjusted to provide efficient trapping of ions. The top endcap electrode 270 can have an injection aperture 278, preferably on or near the Z axis. Ions or ionizing radiation can be injected into the trapping volume 290 through the injection aperture 278. For example, a neutral sample gas can be ionized in-situ by electron-impact ionization by injecting electrons from an external electron source through the injection aperture 278 into the trapping volume 290. The bottom endcap electrode 230 can have an extraction aperture 238, preferably on or near the Z axis. Ions can be ejected from the trapping volume 290 through the extraction aperture 238 for collection by the ion collector 210. The size of the injection and extraction apertures 278 and 238 can be chosen small enough to not substantially perturb the trapping field or as large as the cylindrical hole in the ring electrode 250. Air gaps 260 and 240 between the ring electrode 250 and the top and bottom endcap electrodes 270 and 230 electrically isolate the electrodes from each other. An air gap 220 also electrically isolates the bottom endcap electrode 230 from the ion collector 210. The insulating substrate 280 can comprise a dielectric layer 282 coated on a substrate 281 to electrically isolate the substrate 281 from the ion collector 210, the ion collector interconnect structure 211, and the anchors 231, 251, and 271.

Each electrode is electrically and mechanically interconnected with adjacent electrodes in the same layer and each interconnect structure is mechanically suspended from and anchored to the substrate by posts. Each ion collector 210 is connected to adjacent ion collectors in the same layer 310 by an ion collector interconnect structure 211. The bottom endcap electrode interconnect structure 233 electrically and mechanically interconnects each bottom endcap electrode 230 to adjacent bottom endcap electrodes in the same layer 330. The interconnect structure 233 is mechanically supported by a bottom endcap electrode post, comprising filled through-via 232 and anchor 231. The ring electrode interconnect structure 255 electrically and mechanically interconnects each ring electrode 250 to adjacent ring electrodes in the same layer 350. Filled through-vias 252, 253, and 254 and anchor 251 form a ring electrode post that mechanically connects the suspended ring electrode layer 350, comprising ring electrodes 250 and interconnect structure 255, to the substrate 280. Similarly, a top endcap electrode interconnect structure 277 electrically and mechanically interconnects each top endcap electrode 270 to adjacent top endcap electrodes in the same layer 370. Filled through-vias 272, 273, 274, 275, and 276 and anchor 271 form a top endcap electrode post that mechanically connects the suspended top endcap electrode layer 370 to the substrate 280. The interconnected electrodes or the ion collectors in each layer can be connected through their respective posts to four electrical contact pads at the periphery of the array to provide electrical input and output to the trap elements.

In FIG. 13A is shown a perspective view of a three-dimensional model of a single microfabricated ion trap 200, comprising top endcap electrode 270, ring electrode 250, bottom endcap electrode 230, and ion collector 210. In FIG. 13B is shown a perspective view of a microfabricated array 300 of four ion traps, comprising top endcap electrode layer 370, ring electrode layer 350, bottom endcap electrode layer 330, and ion collector layer 310.

In an alternative embodiment, the ion collector can be eliminated and the bottom endcap electrode can either be built directly on a substrate coated with a dielectric isolation layer, or the trap can be built to have an air gap between the substrate and the bottom endcap electrode. This simple trap may be preferable for ion storage applications. Furthermore, since ions can both be injected and ejected through the injection apertures, an ion detector(s) can be placed on the topside of the trap. Ion detection may also be possible by measuring the weak image currents induced by the orbiting trapped ions in a conducting substrate.

The trap further comprises a power supply to apply voltages to the electrodes. A rf drive voltage V is applied between the ring electrode and the endcap electrodes. A dc or rf voltage $V_{endcap}$ can be applied between the two endcap electrodes. A parasitic capacitance exists in the array due to the direct overlap between the endcap electrodes, the ring electrode, and the interconnect structures. This overlap capacitance will cause a power loss that can become large at high drive frequencies. The power loss can be reduced by increasing the interelectrode spacing or reducing the overlap area.

Mass analysis can typically be performed by stepping or ramping the applied rf drive voltage to cause ions of increasing m/z to become unstable in the Z-direction and be ejected from the trapping volume through the extraction aperture. Ions can also be ejected from by application of a dc pulse to an endcap electrode. The ejected ions can be collected by the ion collector. A voltage $V_{ion}$ can be applied to the ion collector to collect the ion current that is ejected from the trap through the extraction aperture. The collected ion charge can be measured by detector electronics (not shown) and analyzed by suitable signal processing methods. Alternatively, the ring voltage V can further comprise a dc voltage in addition to the rf drive voltage to isolate stable ions. Various methods of ion isolation that can be used with the present invention including apex isolation, stored-waveform inverse Fourier transform (SWIFT), filtered noise field (FNF), and selected ion storage. See Guan et al., *Int. J. Mass Spectrom. And Ion Processes* 157/158, 5 (1996); Kenny et al., *Rapid Commun. Mass Spectrom.* 7, 1086 (1993); and Wells et al., *Anal. Chem.* 67, 3650 (1995), which are incorporated herein by reference.

Microfabrication of the Ion Trap

The ion trap array, comprising a plurality of microscale ion traps, can be fabricated on a substrate by surface micromachining techniques generally known to the IC manufacturing and MEMS industries. Preferably, the ion trap array can be fabricated using a metal damascene process to build up successive layers of the ion trap structure. Metal damascene is an inlaid process in which a trench is formed in a surface layer and a metal overfill is deposited into the trench. A chemical-mechanical-polishing (CMP) step is used to re-planarize the surface and isolate the metal in the trench. With CMP, the thickness of the layer can be precisely adjusted to provide precise vertical dimensioning of the layers. Without the use of CMP, the surface topology would become increasingly severe as each succeeding layer is deposited upon the underlying patterned layer of material. The metal damascene process of the present invention provides superior dimensional control over a typical metal etch process.

In FIGS. 14A–14I are shown schematic cross-sectional views of a seven-layer metal damascene process to fabricate a parallel array of microscale ion traps on a common substrate. Preferably, the ion trap array comprises a plurality of microscale ion traps in a hexagonal close packed (HCP) arrangement. Only a single exemplary ion trap of a multi-trap array is shown to illustrate the fabrication method. The method shown provides an ion trap array having an ion collector that can be used for mass analysis. A simpler ion trap array without an ion collector, useful for ion storage applications, requires as few as five process layers.

Figure 14A:
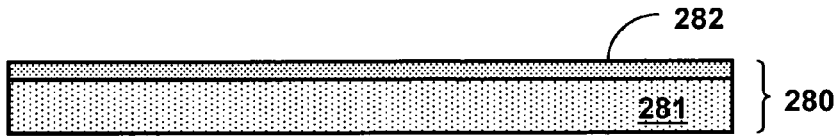

In FIG. 14A, an insulating substrate 280 is provided on which the multi-layer structure of the ion trap array can be fabricated. The insulating substrate 280 can comprise a dielectric isolation layer 282 on an insulating, semiconducting, or conducting substrate 281. The substrate 281 is preferably a single crystal silicon wafer. The dielectric isolation layer 282 can be deposited on the substrate 281 to provide for electrical isolation of the ion collector layer 310 from the substrate 281. Preferably, the dielectric isolation layer 282 comprises silicon nitride deposited by chemical vapor deposition (CVD).

Figure 14B:
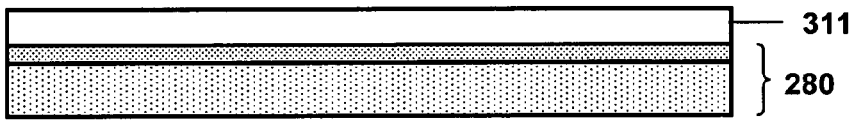

In FIG. 14B, a first sacrificial layer 311, comprising a sacrificial mold material, is deposited on the insulating substrate 280. The sacrificial mold material can be a material that is easily dissolved using etchants that do not attack the substrate (e.g., silicon), dielectric isolation layer (e.g., silicon nitride), or the electrode material (e.g., tungsten). The sacrificial mold material is preferable silicon dioxide. Relatively thick layers of low-stress $SiO_2$ can be deposited at a reasonable deposition rate using plasma-enhanced CVD with tetraethylorthosilicate (PECVD-TEOS) as a source gas. The thickness of the first sacrificial layer 311 can be slightly greater than the desired thickness of the ion collector layer 310.

Figure 14C:
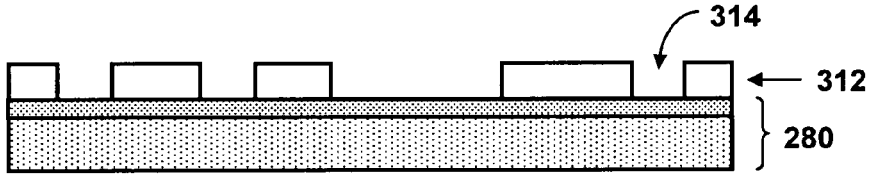

In FIG. 14C, the first sacrificial layer 311 is patterned to form trenches 314 for the plurality of ion collectors 210, the structural anchors 231, 251 and 271, and the ion collector interconnect structure 211. The patterning can be accomplished using a photolithographic etch mask (not shown) over the sacrificial layer with openings in the etch mask to define the locations where the sacrificial mold material is to be removed to form the trenches. An anisotropic etching process (e.g., reactive ion etching directed normal to the surface) can etch the trenches completely down through the sacrificial layer to the dielectric isolation layer. The etch mask can then be stripped, resulting in a first patterned mold layer 312. The trenches for the anchors 231, 251 and 271 should be deep enough to prevent the suspended electrode layers from collapsing following release of the ion trap structure.

Figure 14D:
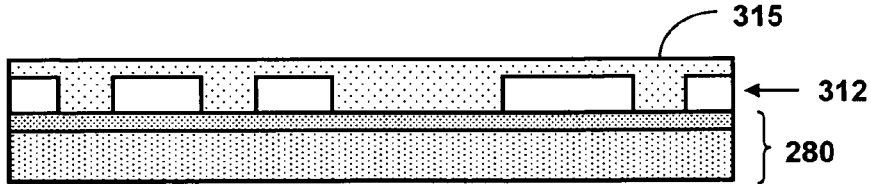

In FIG. 14D, the first patterned mold layer 312 is backfilled by a blanket deposition of an excess of ion collector material 315. The ion collector material 315 can be an electrically conducting or doped semiconducting material, such as tungsten, aluminum, or doped-silicon. For example, the ion collector material 315 can be tungsten that is chemical vapor deposited at high pressure (e.g., 90 Torr) from $WF_6$ and $H_2$. Because CVD tungsten does not adhere to silicon dioxide, the CVD tungsten is grown on a 25 nm TiN adhesion layer deposited by reactive ion sputtering on the patterned sacrificial oxide layer.

Figure 14E:
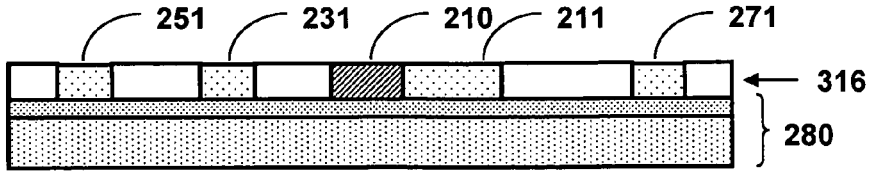

In FIG. 14E, the excess tungsten is removed and the surface of the filled first patterned mold layer is preferably planarized by chemical mechanical polishing (CMP) to provide an ion collector mold layer 316.

Figure 14F:
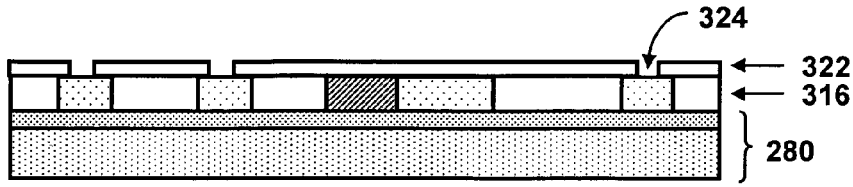

In FIG. 14F, a second layer of sacrificial material is deposited on the ion collector mold layer 316 and patterned to provide a second patterned mold layer 322, comprising trenches 324 for the plurality of filled through-vias 232, 252, and 272. A photolithographic etch mask is again used to define and align vertically adjacent features in the layers of the array.

Figure 14G:
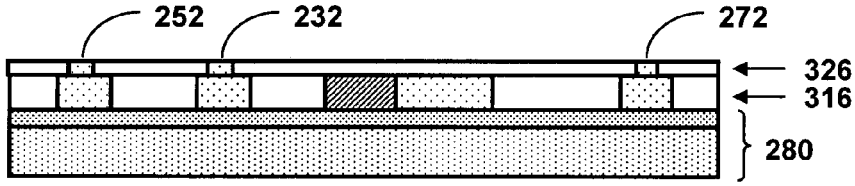

In FIG. 14G, the second patterned mold layer 322 is backfilled with a structural electrode material (e.g., CVD tungsten) and planarized to provide a bottom post mold layer 326. Each filled through-via 232, 252, or 272 in the bottom post mold layer 326 is vertically aligned above a corresponding anchor 231, 251, or 271 in the underlying ion collector mold layer 316. The bottom post mold layer 326 is sufficiently thick to provide the air gap 220 that electrically insulates the bottom endcap electrodes 230 from the ion collectors 210.

Figure 14H:
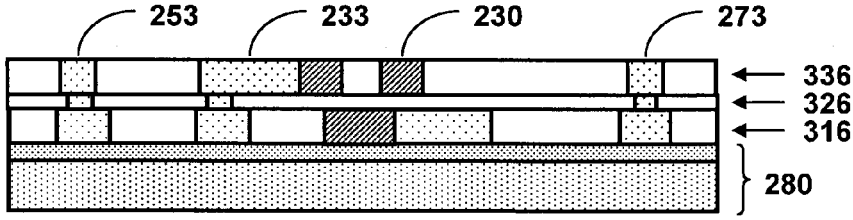

In FIG. 14H, a third layer of sacrificial material is deposited on the bottom post mold layer 326, patterned, backfilled with an electrode material, and planarized to provide a bottom endcap electrode mold layer 336, comprising filled trenches for the bottom endcap electrodes 230, the bottom endcap electrode interconnect structure 233, and the filled through-vias 253 and 273. Each bottom endcap electrode 230 is axially aligned with a corresponding ion collector 210. The bottom endcap electrode interconnect structure 233 is vertically aligned above filled through-vias 232. Likewise, each filled through-via 253 or 273 in the bottom endcap electrode mold layer 336 is vertically aligned above a corresponding filled through-via 252 or 272 in the underlying bottom post mold layer 326. The electrode material is preferably a good electrical conductor with a small rf skin depth, such as aluminum, copper, tungsten, titanium nitride, nickel, chromium, or other interconnect metal.

Figure 14I:
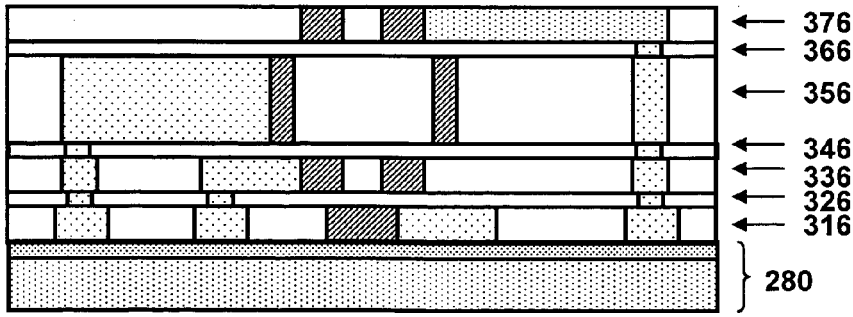

As shown in FIG. 14I, the sequential deposition and patterning of sacrificial mold layers, overfilling with electrode material, and planarization is repeated until the ion trap structure, comprising ion collector mold layer 316, bottom post mold layer 326, bottom endcap electrode mold layer 336, center post mold layer 346, center ring electrode mold layer 356, top post mold layer 366, and top endcap electrode mold layer 376, is built up on the insulating substrate 280. Although a cylindrical ring electrode is shown in this figure, a near-hyberbolic ring electrode can be fabricated by using multiple ring electrode layers, each layer having a different ring diameter, to build up a hyperbolic shape. Likewise, near-hyperbolic shaped endcap electrodes can be fabricated by using multiple endcap layers to build up the endcap electrodes.

Finally, after the ion trap structure is built up, the sacrificial material in the mold layers can be removed and the ion trap structure can be released by etching in a selective etchant. For example, sacrificial oxide can be removed by etching with a HF solution, which etches $SiO_2$, but not W, TiN, $Si_3N_4$, or Si. A free hanging, microfabricated ion trap array results, as shown in FIG. 12.

The resulting microfabricated ion trap array comprises an insulating substrate; an ion collector layer, comprising a plurality of interconnected ion collectors, on the substrate; a bottom endcap electrode layer, comprising a plurality of interconnected bottom endcap electrodes that are vertically aligned with the plurality of ion collectors and separated therefrom by an air gap; a ring electrode layer, comprising a plurality of interconnected ring electrodes that are axially aligned with the plurality of bottom endcap electrodes and separated therefrom by another air gap; and a top endcap electrode layer, comprising a plurality of interconnected top endcap electrodes that are axially aligned with the plurality of ring electrodes and separated therefrom by an air gap.

In FIG. 15 are shown scanning electron microphotographs (SEMs) of an array of microfabricated tungsten ion traps. Trap dimensions as fabricated were $r_0$=0.95 μm, $z_0$=1.25 μm, air gap of 0.5 μm between ring and endcap electrodes, and radius of endcap aperture =0.4 μm. The ring electrode and endcap electrodes are free standing and are electrically isolated from each other and the ion collector with free-space gaps. Mechanical posts connect the electrodes down through the anchors to the substrate surface. Common anchor points serve as electrodes for adjacent traps, allowing for the entire array of traps to be configured and operated in parallel. Electrical contact pads at the periphery of the array provide for electrical input/output to trap elements.

In FIG. 16 are shown SEMs of an array of microfabricated tungsten ion traps with a trap radius of about 10 μm. Because of the larger intraelectrode volume, a plurality of access holes in the top endcap electrode facilitate etching of the underlying sacrificial oxide material.

Fabrication imperfections can affect trap performance. Typical fabrication imperfections include non-vertical (tapered and therefore non-parallel) ring electrode walls and layer misalignment (therefore misalignment of the endcaps with respect to the ring electrode). If controlled, these imperfections can be exploited to favor ion ejection out of one or the other of the endcaps. The effects of these errors were investigated via simulation. A non-vertical ring electrode causes an asymmetry in the potential distribution along the z-axis of the ion trap. Since the ring electrode radius is smaller at the top (entrance) end of the ion trap for non-vertical walls, the potential well is deeper at this end of the trap, and therefore ions will be stored preferentially toward this end and preferentially ejected out of the top end cap electrode (in a symmetrical ion trap with perfectly vertical ring electrode walls, 50% of ions are ejected from each endcap, and those exiting from the top endcap are not detected since there is not generally a detector at this end of the trap). The higher order field contributions also change due to the non-vertical ring electrode walls, however the effect is slight.

The misalignment of end caps with respect to the trap ring electrode for the microfabricated CIT is dictated by the alignment tolerance of the photolithography tool that defines the patterns. The decrease in trapping efficiency is greatest when both end caps are misaligned in the same direction, the effect being less for orthogonal and opposite direction misalignments. However, the actual process-induced misalignment of the end caps has a relatively minor effect on trapping efficiency. Preliminary simulations of the effects of misalignment on ion ejection efficiencies also indicate a minor effect.

The present invention has been described as a microfabricated ion trap array. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A microfabricated ion trap array, comprising:

an insulating substrate;

a bottom endcap electrode layer, comprising a plurality of interconnected bottom endcap electrodes, on the substrate;

a center ring electrode layer, comprising a plurality of interconnected ring electrodes axially aligned with the plurality of bottom endcap electrodes and separated therefrom by an air gap;

a top endcap electrode layer, comprising a plurality of interconnected top endcap electrodes axially aligned with the plurality of ring electrodes and separated therefrom by another air gap; and means for applying an radiofrequency drive voltage between the center ring electrode layer and the endcap electrode layers to provide an ion trap in the intraelectrode volumes formed by the plurality of aligned bottom endcap electrodes, ring electrodes, and top endcap electrodes.

2. The microfabricated ion trap array of claim 1, further comprising an injection aperture in each of the plurality of top endcap electrodes for injecting an ionized or neutral sample gas into each of the intraelectrode volumes.

3. The microfabricated ion trap array of claim 2, wherein each of the injection apertures is substantially on the axis of the corresponding ring electrode.

4. The microfabricated ion trap array of claim 1, further comprising an extraction aperture in each of the plurality of bottom endcap electrodes for ejection of ions from each of the intraelectrode volumes.

5. The microfabricated ion trap array of claim 4, wherein each of the extraction apertures is substantially on the axis the corresponding ring electrode.

6. The microfabricated ion trap array of claim 4, further comprising an ion collector layer between the substrate and the bottom endcap electrode layer, the ion collector layer comprising a plurality of interconnected ion collectors vertically aligned with the plurality of bottom endcap electrodes and separated therefrom by an air gap.

7. The microfabricated ion trap array of claim 1, wherein the plurality of ring electrodes comprise cylindrical ring electrodes.

8. The microfabricated ion trap array of claim 1, wherein the plurality of ring electrodes comprise near-hyperbolic ring electrodes.

9. The microfabricated ion trap array of claim 1, wherein the insulating substrate comprises a dielectric isolation layer on a substrate.

10. The microfabricated ion trap array of claim 9, wherein the substrate comprises silicon.

11. The microfabricated ion trap array of claim 9, wherein the dielectric layer comprises silicon nitride.

12. The microfabricated ion trap array of claim 1, wherein the electrode layers comprise a metal.

13. The microfabricated ion trap array of claim 12, wherein the metal comprises aluminum, copper, tungsten, titanium nitride, nickel, or chromium.

14. The microfabricated ion trap array of claim 1, further comprising means to ionize a sample gas in the intraelectode volume of each of the ion traps.

15. The microfabricated ion trap array of claim 1, wherein each of the ring electrodes has an inner radius of less than ten microns.

16. The microfabricated ion trap array of claim 1, wherein each of the ring electrodes has an inner radius of less than one micron.

17. The microfabricated ion trap array of claim 1, further comprising means for applying a radiofrequency voltage between the bottom endcap electrode layer and the top endcap electrode layer.

18. The microfabricated ion trap array of claim 1, further comprising means for applying a direct current voltage between the bottom endcap electrode layer and the top endcap electrode layer.

19. The microfabricated ion trap array of claim 1, further comprising means for applying a direct current voltage between the center ring electrode layer and the endcap electrode layers.

20. A method for fabricating an ion trap array, comprising:

providing an insulating substrate;

forming a bottom endcap electrode mold layer on the substrate; wherein the bottom endcap electrode mold layer comprises a plurality of bottom endcap electrodes, a bottom electrode interconnect structure that electrically interconnects the plurality of bottom endcap electrodes, a plurality of ring electrode through-vias, and a plurality of top endcap electrode through-vias, embedded in a sacrificial material;

forming a center post mold layer on the bottom endcap electrode mold layer; wherein the center post mold layer comprises a plurality of ring electrode through-vias and a plurality of top endcap electrode through-vias wherein each through-via is vertically aligned with a corresponding through-via in the bottom endcap electrode mold layer, embedded in the sacrificial material;

forming a center ring electrode mold layer on the center post mold layer;

wherein the center ring electrode mold layer comprises a plurality of ring electrodes wherein each ring electrode is axially aligned with a corresponding bottom endcap electrode, a ring electrode interconnect structure that electrically interconnects the plurality of ring electrodes and is vertically aligned with the ring electrode through-vias in the center post mold layer, and a plurality of top endcap electrode through-vias wherein each through-via is vertically aligned with a corresponding top endcap electrode through-via in the center post mold layer, embedded in the sacrificial material;

forming a top post mold layer on the ring electrode mold layer; wherein the top post mold layer comprises a plurality of top endcap electrode through-vias wherein each through-via is vertically aligned with a corresponding through-via in the center ring electrode mold layer, embedded in the sacrificial material;

forming a top endcap electrode mold layer on the top post mold layer; wherein the top endcap electrode mold layer comprises a plurality of top endcap electrodes wherein each top endcap electrode is axially aligned with a corresponding ring electrode, and a top endcap electrode interconnect structure that electrically interconnects the plurality of top endcap electrodes and is vertically aligned with the top endcap electrode through-vias in the top post mold layer, embedded in the sacrificial material; and removing the sacrificial mold material in the mold layers to release the ion trap array.

21. The method of claim 20, wherein the bottom endcap electrode mold layer forming step comprises:

depositing a sacrificial layer on the insulating substrate;

patterning the sacrificial layer to provide a patterned mold layer comprising trenches for the bottom endcap electrodes, the bottom electrode interconnect structure, the ring electrode through-vias, and the top endcap electrode through-vias;

filling the trenches in the patterned mold layer with an electrode material; and planarizing the patterned mold layer to provide the bottom endcap electrode mold layer.

22. The method of claim 20, wherein the center post mold layer forming step comprises:

depositing a sacrificial layer on the bottom endcap electrode mold layer;

patterning the sacrificial layer to provide a patterned mold layer comprising trenches for the ring electrode through-vias and the top endcap electrode through-vias;

filling the trenches in the patterned mold layer with a structural material; and planarizing the filled patterned mold layer to provide the center post mold layer.

23. The method of claim 20, wherein the center ring electrode mold layer forming step comprises:

depositing a sacrificial layer on the center post mold layer;

patterning the sacrificial layer to provide a patterned mold layer comprising trenches for the ring electrodes, the ring electrode interconnect structure, and the top endcap electrode through-vias;

filling the trenches in the patterned mold layer with an electrode material; and planarizing the filled patterned mold layer to provide the center ring electrode mold layer.

24. The method of claim 20, wherein the top post mold layer forming step comprises:

depositing a sacrificial layer on the center ring electrode mold layer;

patterning the sacrificial layer to provide a patterned mold layer comprising trenches for the top endcap electrode through-vias;

filling the trenches in the patterned mold layer with a structural material; and planarizing the filled patterned mold layer to provide the top post mold layer.

25. The method of claim 20, wherein the top endcap electrode mold layer forming step comprises:

depositing a sacrificial layer on the top post mold layer;

patterning the sacrificial layer to provide a patterned mold layer comprising trenches for the top endcap electrodes and the top endcap electrode interconnect structure;

filling the trenches in the patterned mold layer with an electrode material; and planarizing the filled patterned mold layer to provide the top endcap electrode mold layer.

26. The method of claim 20, further comprising, prior to the bottom post mold layer forming step:

forming an ion collector mold layer on the substrate; wherein the ion collector mold layer comprises a plurality of ion collectors wherein each ion collector is vertically aligned with a corresponding bottom endcap electrode, an ion collector interconnect structure that electrically interconnects the plurality of ion collectors, a plurality of bottom endcap electrode anchors, a plurality of ring electrode anchors, and a plurality of top endcap electrode anchors, in the sacrificial material; and forming a bottom post mold layer on the ion collector mold layer; wherein the bottom post mold layer comprises a plurality of bottom endcap electrode through-vias wherein each through-via is vertically aligned above a corresponding bottom endcap electrode anchor to support the bottom endcap electrode interconnect structure, a plurality of ring electrode through-vias wherein each through-via is vertically aligned between a corresponding ring electrode anchor in the ion collector mold layer and a corresponding ring electrode through-via in the bottom endcap electrode mold layer, and a plurality of top endcap electrode through-vias wherein each through-via is vertically aligned between a corresponding top endcap electrode anchor in the ion collector mold layer and a corresponding top endcap electrode through-via in the bottom endcap electrode mold layer, in the sacrificial material.

27. The method of claim 26, wherein the ion collector mold layer forming step comprises:

depositing a sacrificial layer, comprising the sacrificial material, on the insulating substrate;

patterning the sacrificial layer to provide a patterned mold layer comprising trenches for the plurality of ion collectors, the ion collector interconnect structure, the plurality of bottom endcap electrode anchors, the plurality of ring electrode anchors, and the plurality of top endcap electrode anchors;

filling the trenches in the patterned mold layer with an ion collector 10 material; and planarizing the filled patterned mold layer to provide the ion collector mold layer.

28. The method of claim 26, wherein the bottom post mold layer forming step comprises:

depositing a sacrificial layer on the ion collector mold layer;

patterning the sacrificial layer to provide a patterned mold layer comprising trenches for the bottom endcap electrode through-vias, the ring electrode through-vias, and the top endcap electrode through-vias;

filling the trenches in the patterned mold layer with a structural material; and planarizing the filled patterned mold layer to provide the bottom post mold layer.

* * * * *